US011408108B2

(12) United States Patent
Chae et al.

(10) Patent No.: US 11,408,108 B2
(45) Date of Patent: Aug. 9, 2022

(54) WASHING MACHINE

(71) Applicant: LG Electronics Inc., Seoul (KR)

(72) Inventors: Kyosoon Chae, Seoul (KR); Hyundong Kim, Seoul (KR); Sooyoung Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 134 days.

(21) Appl. No.: 16/845,986

(22) Filed: Apr. 10, 2020

(65) Prior Publication Data

US 2020/0325612 A1 Oct. 15, 2020

(30) Foreign Application Priority Data

Apr. 12, 2019 (KR) ..... 10-2019-0042786

(51) Int. Cl.
*D06F 34/14* (2020.01)
*D06F 33/37* (2020.01)
(Continued)

(52) U.S. Cl.
CPC ..... *D06F 34/14* (2020.02); *D06F 33/37* (2020.02); *D06F 39/02* (2013.01); *D06F 39/022* (2013.01);
(Continued)

(58) Field of Classification Search
CPC ..... D06F 33/37; D06F 33/57; D06F 34/18; D06F 39/02; D06F 39/022; D06F 2103/22; D06F 2105/42
See application file for complete search history.

(56) References Cited

U.S. PATENT DOCUMENTS

2006/0254626 A1* 11/2006 Botts ..... B08B 3/14 134/110
2009/0288453 A1* 11/2009 Lee ..... D06F 39/022 68/17 R
(Continued)

FOREIGN PATENT DOCUMENTS

DE 102007050920 12/2008
EP 2733249 5/2014
(Continued)

OTHER PUBLICATIONS

Machine translation of KR 10-2015-0103988 A to LG Electronics Inc. (Year: 2015).*
(Continued)

*Primary Examiner* — Joseph L. Perrin
(74) *Attorney, Agent, or Firm* — Fish & Richardson P.C.

(57) ABSTRACT

According to the present disclosure, a washing machine may comprise a cabinet, a tub disposed in the cabinet to receive water, a drum rotatably disposed in the tub to contain a laundry and a detergent supply device disposed at the cabinet to supply detergent into the tub, wherein the detergent supply device comprises a plurality of cartridges containing detergent, a pump suctioning detergent from the plurality of cartridges, a passage guiding detergent discharged from the pump into the tub and a plurality of electrode sensors disposed at a side of the plurality of cartridges, wherein each of the plurality of electrode sensors comprises an electrode plate detecting electric signal and a terminal transmitting the electric signal detected by the electrode plate, wherein the electrode plate has a first surface contacted with detergent contained in the cartridge and a second surface connected to the terminal.

21 Claims, 21 Drawing Sheets

(51) Int. Cl.

| | |
|---|---|
| ***D06F 39/02*** | (2006.01) |
| ***D06F 105/42*** | (2020.01) |
| ***D06F 103/22*** | (2020.01) |
| ***D06F 33/57*** | (2020.01) |

(52) U.S. Cl.
CPC ..... *D06F 33/57* (2020.02); *D06F 2103/22* (2020.02); *D06F 2105/42* (2020.02)

(56) References Cited

U.S. PATENT DOCUMENTS

| | | | | |
|---|---|---|---|---|
| 2010/0000578 | A1* | 1/2010 | Hendrickson ..... | D06F 39/028 134/34 |
| 2010/0161143 | A1 | 6/2010 | Smith et al. | |
| 2013/0133700 | A1 | 5/2013 | Classen et al. | |
| 2015/0252513 | A1 | 9/2015 | Seo et al. | |
| 2017/0127905 | A1* | 5/2017 | DeWeerd ..... | A47L 15/449 |

FOREIGN PATENT DOCUMENTS

| | | |
|---|---|---|
| EP | 2521811 B1 | 3/2015 |
| JP | 2018011618 | 1/2018 |
| KR | 1019990074113 | 10/1999 |
| KR | 1020080014132 | 2/2008 |
| KR | 1020110099288 | 9/2011 |
| KR | 1020130062271 | 6/2013 |
| KR | 1020150103988 | 9/2015 |
| WO | WO2005021857 | 3/2005 |

OTHER PUBLICATIONS

Extended European Search Report in European Application No. 20169302.5, dated Aug. 26, 2020, 6 pages.
PCT International Search Report in International Application No. PCT/KR2020/004927, dated Aug. 7, 2020, 4 pages.

* cited by examiner

WASHING MACHINE

CROSS-REFERENCE TO RELATED APPLICATION

This application claims the benefit of priority to Korean Application No. 10-2019-0042786, filed on Apr. 12, 2019, the disclosure of which is incorporated by reference in its entirety.

BACKGROUND

Field

The present disclosure relates to a washing machine, and more particularly, to a washing machine capable of automatically providing the washing machine with various detergents.

Related Art

A washing machine is a device handling laundry through washing, dehydration and/or drying and the like. The washing machine is a device removing contamination of a laundry by using water and detergents.

Recently, there is a need to develop a device automatically mixing and providing various detergents according to various laundries, so technical features related therewith are under development.

During supplying various detergents, it is necessarily required to employ detecting function to let user refill detergent in case of lack of detergent in a cartridge.

U.S. Patent Publication No. 2010/0161143 A1 discloses detecting residual amount of detergent of the cartridge with a sensor for detecting residual liquid. At this case, detecting detergent is performed by penetration of light using a source of light like LED or something. That is, an electric signal is variable according to a type of detergent or properties of a cartridge. In other words, an electric signal detected by penetrating rate of light is variable according to a circumstance employing a washing machine, or to incorrectly mounted cartridge, so there may be a problem to precisely detect a residual amount of detergent.

SUMMARY

One object of the present disclosure is to provide a washing machine capable of precisely detecting a residual amount of detergent regardless of installation environment.

Another object of the present disclosure is to provide a washing machine capable of precisely detecting a residual amount of detergent regardless of properties and size of a cartridge.

Another object of the present disclosure is to provide a washing machine capable of simply detecting a residual amount of detergent.

Objects of the present disclosure should not be limited to the aforementioned objects and other unmentioned objects will be clearly understood by those skilled in the art from the following description.

In accordance with an embodiment of the present disclosure, the above and other objects can be accomplished by the provision of washing machine including a cabinet, a tub disposed in the cabinet to receive water, a drum rotatably disposed in the tub to contain a laundry and a detergent supply device disposed at the cabinet to supply detergent into the tub, wherein the detergent supply device comprises a plurality of cartridges containing detergent, a pump suctioning detergent from the plurality of cartridges, a passage guiding detergent discharged from the pump into the tub and a plurality of electrode sensors disposed at a side of the plurality of cartridges, wherein each of the plurality of electrode sensors comprises an electrode plate detecting electric signal and a terminal transmitting the electric signal detected by the electrode plate, wherein the electrode plate has a first surface contacted with detergent contained in the cartridge and a second surface connected to the terminal.

The electrode plate may have a smaller width at a lower end thereof than an upper end thereof.

An opening may be formed at a rear wall of the cartridge, and the electrode plate is disposed to be in a contact with the rear wall of the cartridge so that the first surface thereof is exposed to the opening.

The opening may be disposed to be in a contact with a lower end of the electrode plate.

The opening may be spaced apart from a lower surface of the cartridge.

The detergent supply device may further comprise a docking valve disposed at a lower side of the rear wall of the cartridge, the docking valve connecting the pump and the cartridge, wherein the docking valve is provided with a detergent inlet through which detergent in the cartridge is sucked into the pump, and the opening is disposed at a position higher than the detergent inlet.

The washing machine may further comprise a housing accommodating the cartridge, the housing having a connecting wall which is disposed in a rear direction of the cartridge, wherein the electrode plate is disposed between the connecting wall of the housing and the cartridge rear wall of the cartridge.

The detergent supply device may further comprise a housing accommodating the cartridge, wherein the terminal comprising a connecting portion connecting to the housing, a first curved portion bending from the connector and a second curved portion bending upward the cartridge from the first curved portion, wherein a protruding portion is included in the second curved portion to contact the electrode plate.

The housing may comprise a connecting wall disposed in a rear direction of the cartridge, wherein the connecting portion of the terminal is connected to the connecting wall.

The connecting portion may be mounted to a protrusion protruded from the connecting wall in an opposite direction from the cartridge.

The protruding portion may be contacted with the second surface of the electrode plate.

A connecting wall opening may be formed at the connecting wall, and the electrode plate is contacted with the protruding portion through the connecting wall opening.

The electrode plate may be formed in a shape of 'L'.

The plurality of electrode sensors may comprise at least two of the plurality of electrode sensors have a different height each other.

The washing machine may comprise three electrode sensors including three electrode plates and three terminals are disposed at the side of the cartridge, wherein the three electrode plates comprise a first and second electrode plates having a height of a first height and a third electrode plate having a height of a second height higher than the first height.

Each of the first and second electrode plates may be formed in a shape of 'L'.

A first, second and third openings corresponding to the first, second and third electrode plates may be formed at a rear wall of the cartridge, and wherein the first surface of the first, second and third electrode plates contact with the detergent contained in the cartridge through the first, second and third openings.

The first and second openings may be spaced apart from a bottom surface of the cartridge.

The first, second and third openings may be disposed respectively at a lower end of the first, second and third electrode plates.

The electric signal may be an electric current or an electric voltage generated between the two electrode plates disposed at the side of the cartridge.

The washing machine including the same according to the present disclosure provide at least the following effects.

First, the washing machine according to an exemplary embodiment of the present disclosure has an advantage of reducing a chance of misjudging of a detergent supply device by directly detecting a residual amount of detergent with making use of a change of an electric signal.

Second, the washing machine according to an exemplary embodiment of the present disclosure has an advantage of precisely detecting a residual amount of detergent regardless of properties and size of a cartridge because of using an electric current electrified through detergent.

Third, the washing machine according to an exemplary embodiment of the present disclosure has an advantage of having a simple operating procedure because of using an electric current electrified through detergent contained in a cartridge.

Fourth, the washing machine according to an exemplary embodiment of the present disclosure has an advantage of simplifying a structure for detecting a residual amount of detergent because there is a need for only terminal and electric wire.

Fifth, the washing machine according to an exemplary embodiment of the present disclosure has an advantage of reducing a chance that detergent is hardened in a terminal because a contacting portion between the terminal and detergent is small.

It should be understood that advantageous effects according to the present disclosure are not limited to the effects set forth above and other advantageous effects of the present disclosure will be apparent from the detailed description of the present disclosure.

Details of other embodiments will be described in the detailed description with reference to the accompanying drawings.

DETAILED DESCRIPTION

Figure 1:
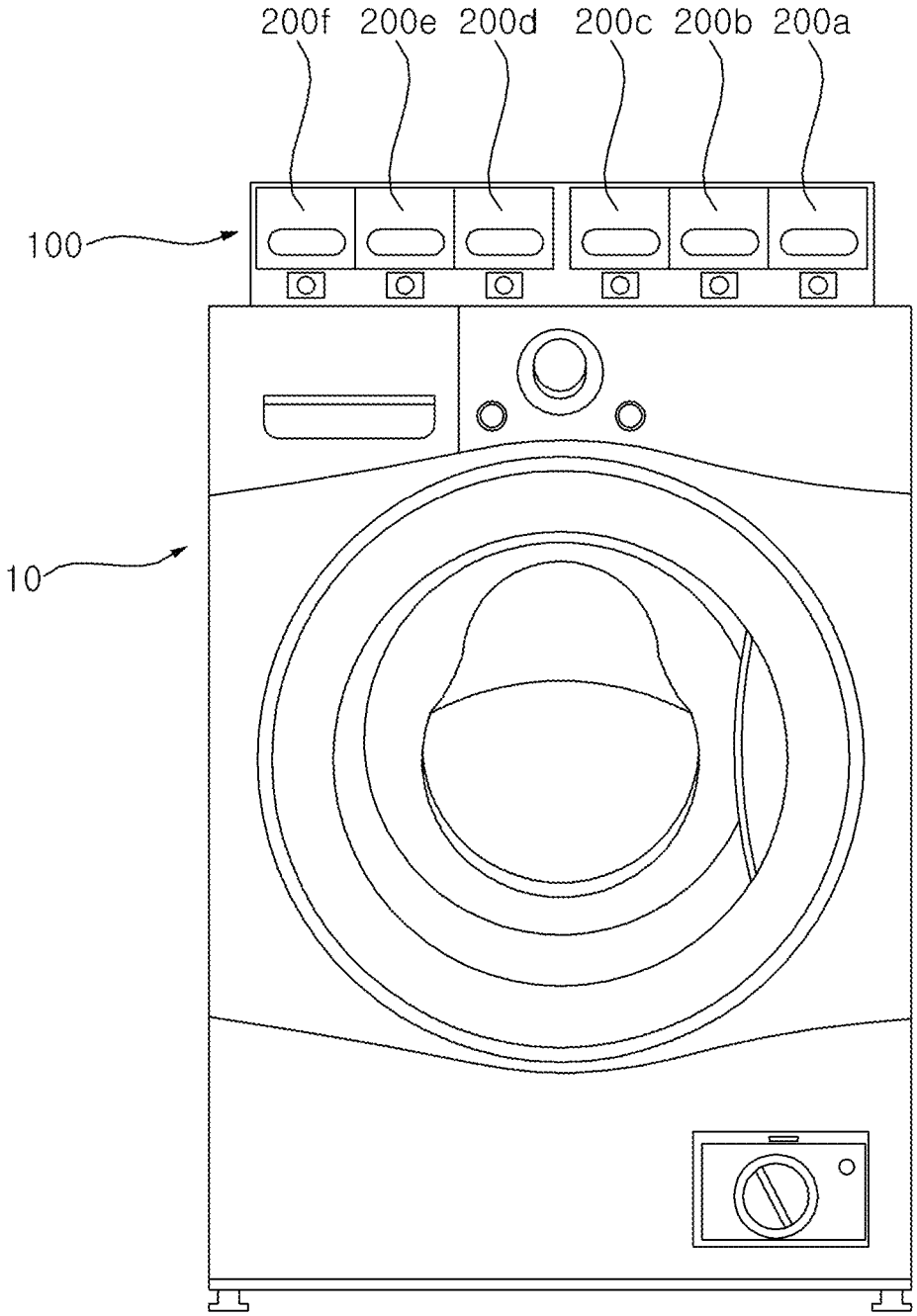
FIG. 1 is a front view of a washing machine according to an exemplary embodiment of the present disclosure.

Advantages and features of the present disclosure and methods of achieving the advantages and features will be apparent with reference to embodiments described below in detail in conjunction with the accompanying drawings. However, the present disclosure is not limited to embodiments disclosed below, but may be implemented in various forms, only the present embodiments are provided so that a disclosure of the present disclosure is complete and a disclosure of a scope of the present application is fully understood by those skilled in the art to which the present disclosure belongs, and the present disclosure is only defined by the scope of the claims. The same reference numerals indicate the same components through the specification.

Hereinafter, a washing machine according to an exemplary embodiment of the present disclosure will be described with reference to the accompanying drawings.

Figure 2:
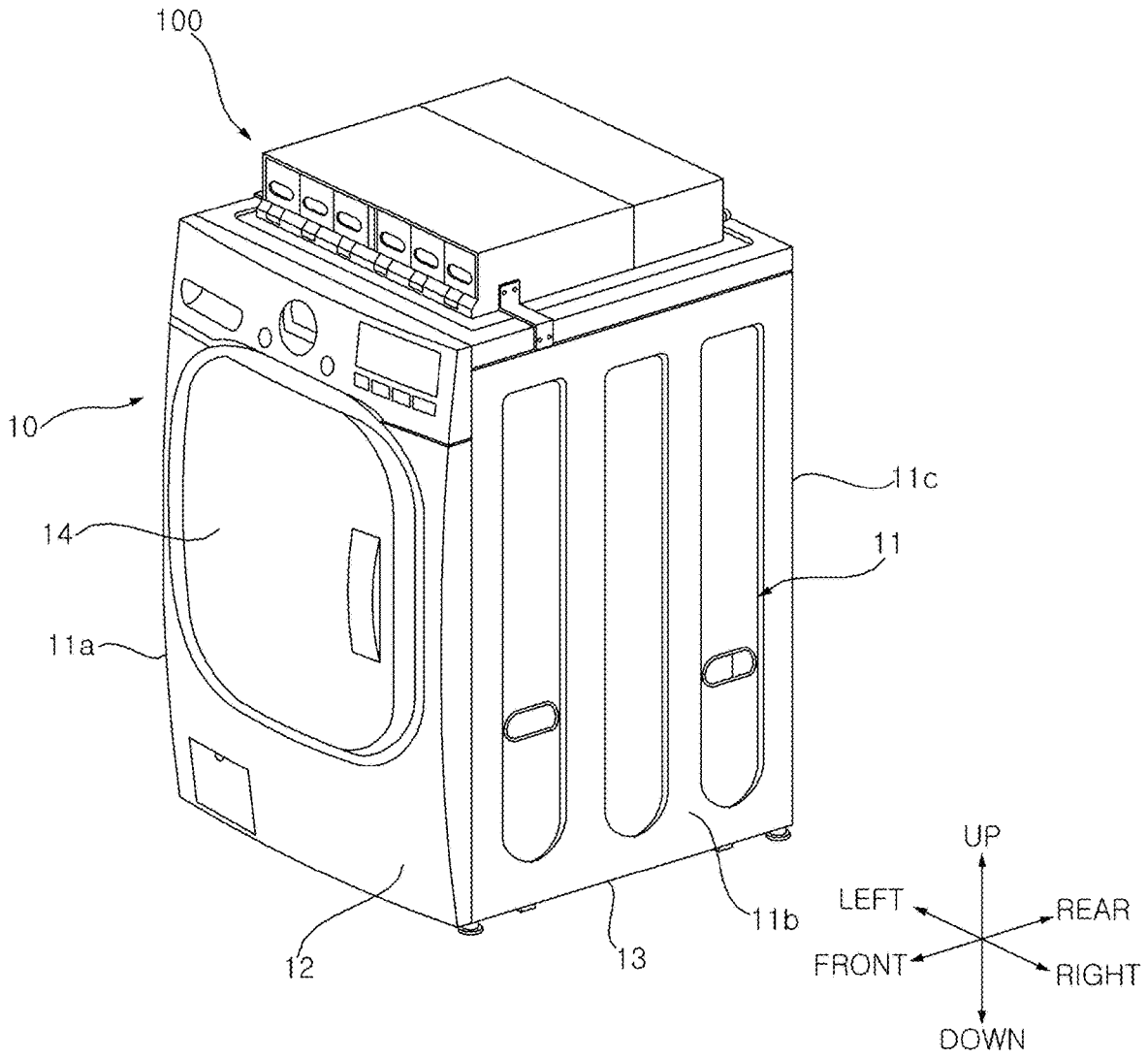
FIG. 2 is a perspective view of the washing machine according to an exemplary embodiment of the present disclosure.
Figure 3:
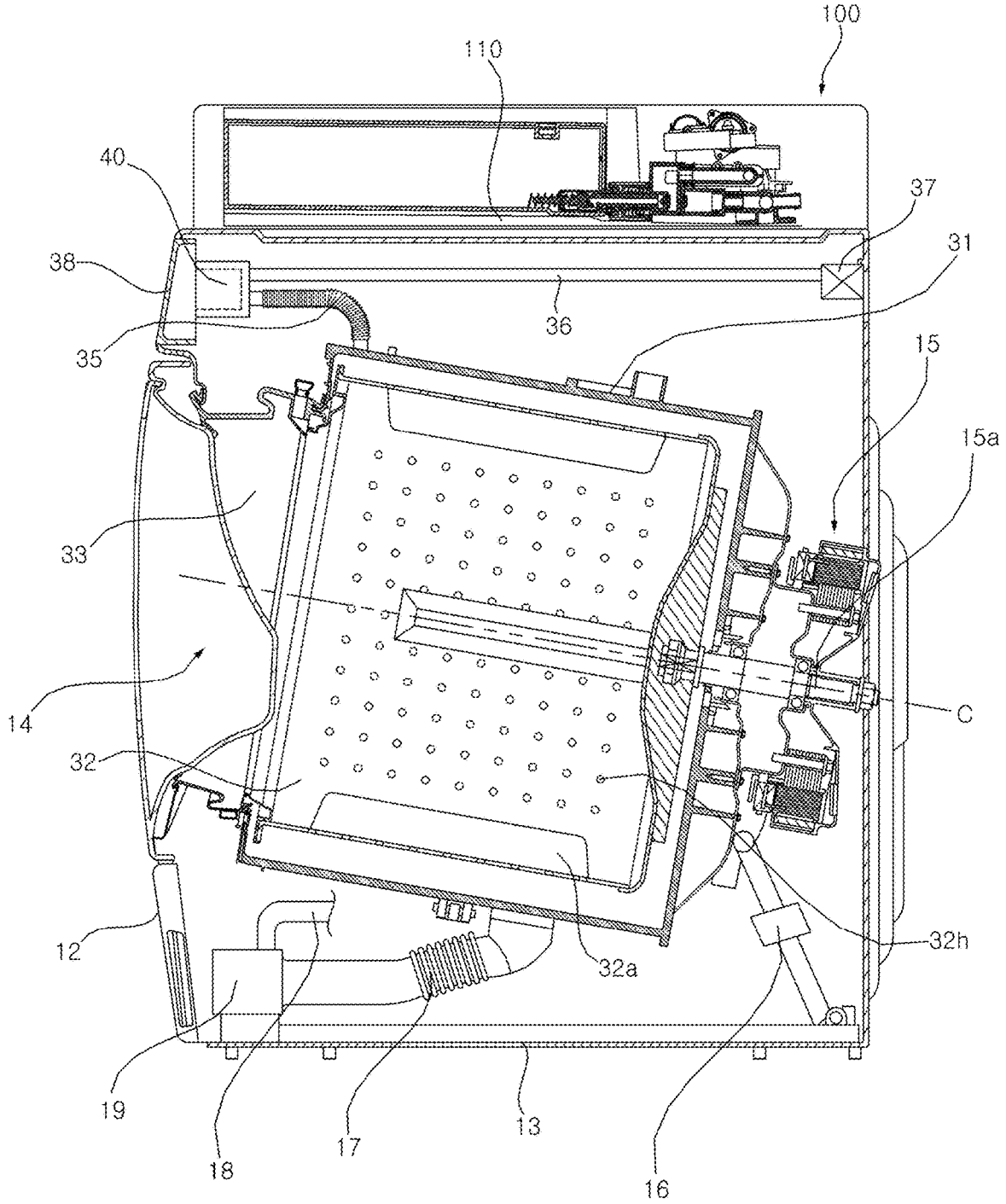
FIG. 3 is a lateral cross-sectional view of the washing machine according to an exemplary embodiment of the present disclosure.
Figure 4:
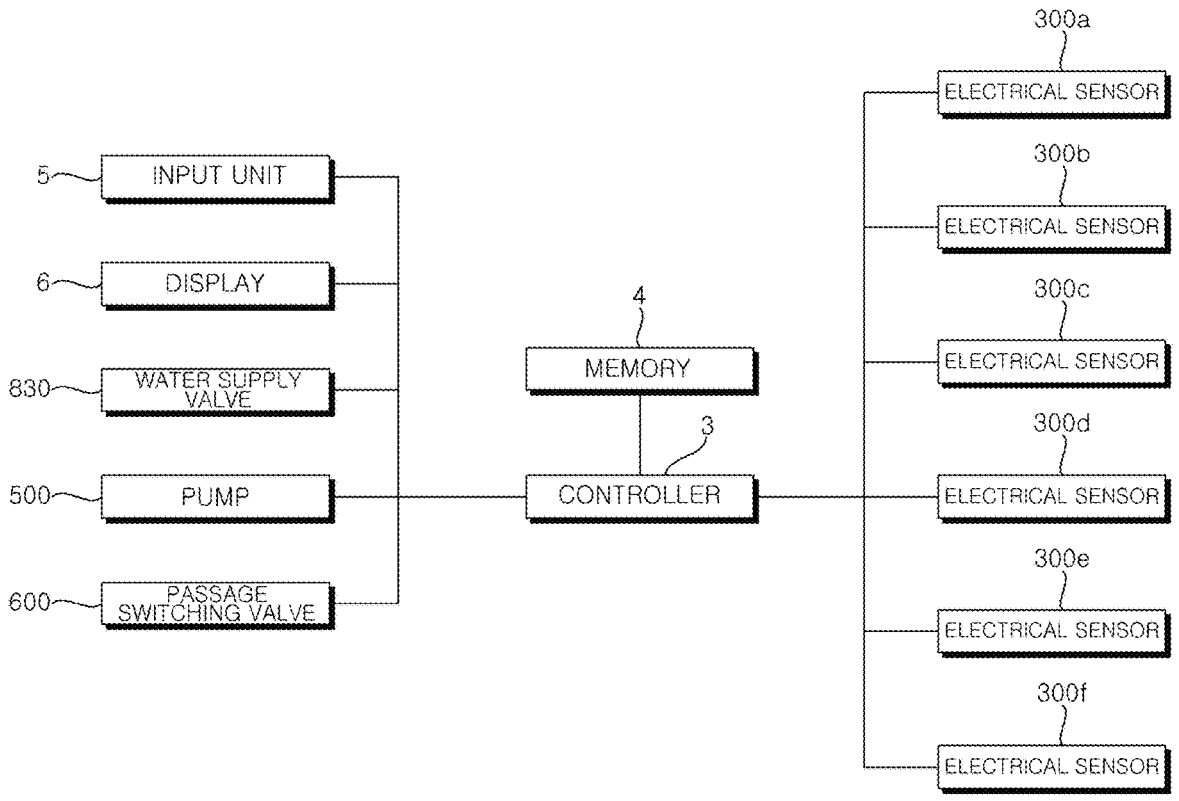
FIG. 4 is a flow chart of the washing machine according to an exemplary embodiment of the present disclosure.
Figure 5:
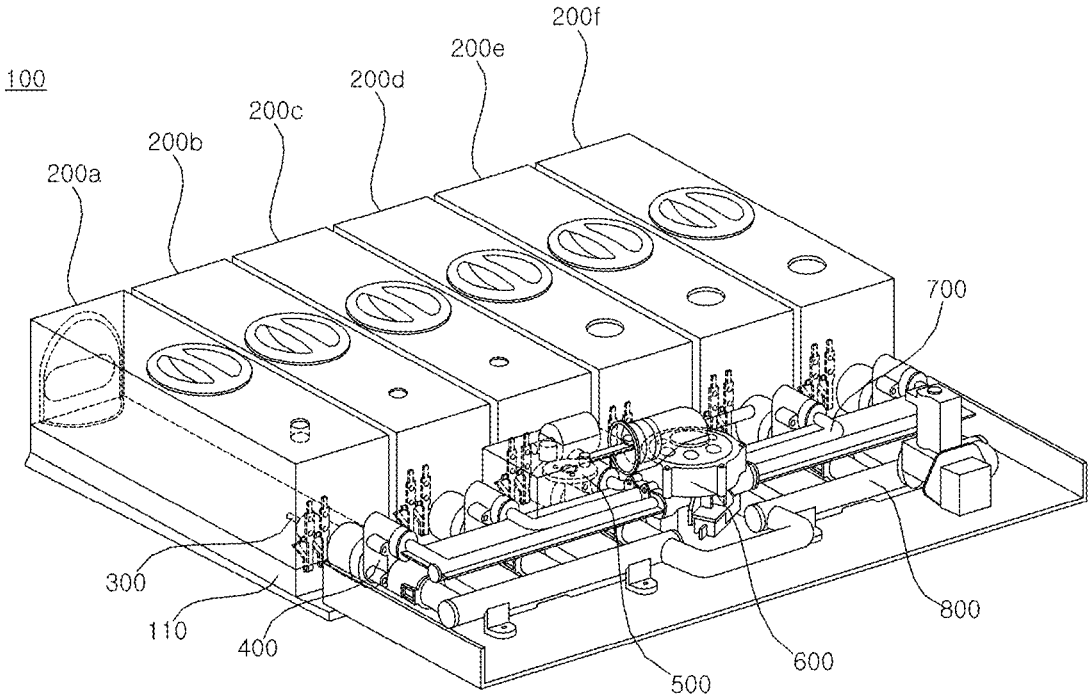
FIG. 5 is a schematic view of a detergent supply device according to an exemplary embodiment of the present disclosure.
Figure 6:
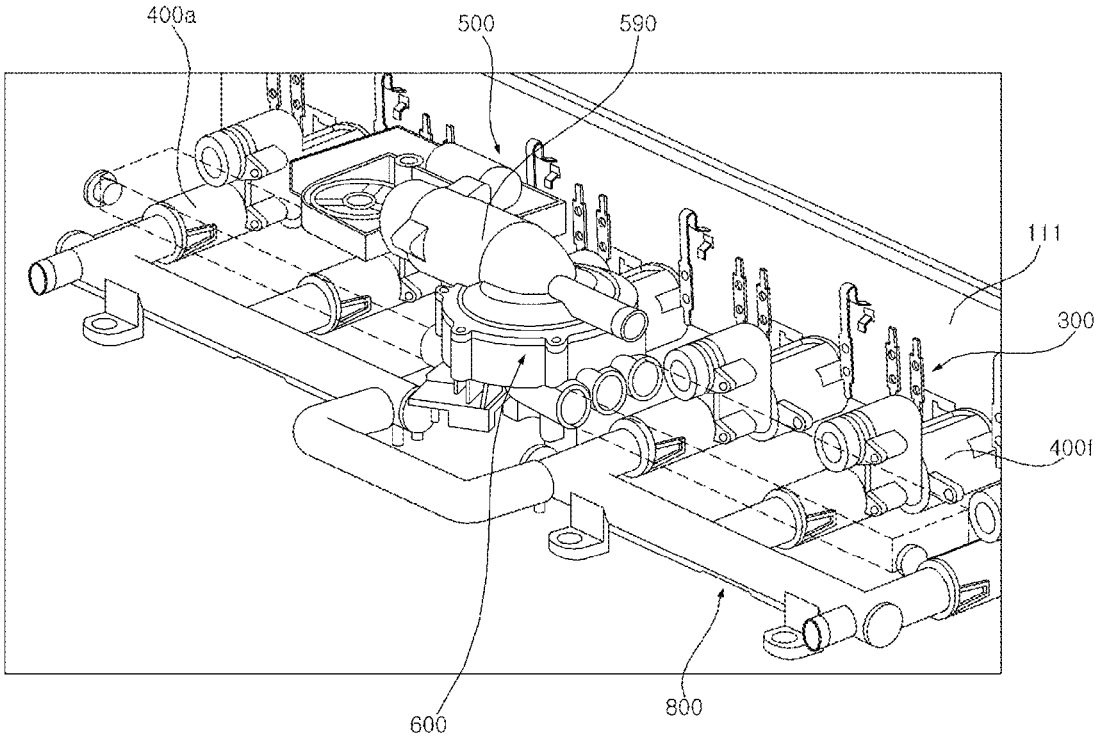
FIG. 6 is a schematic view showing a rear side of the detergent supply device according to an exemplary embodiment of the present disclosure.
Figure 7:
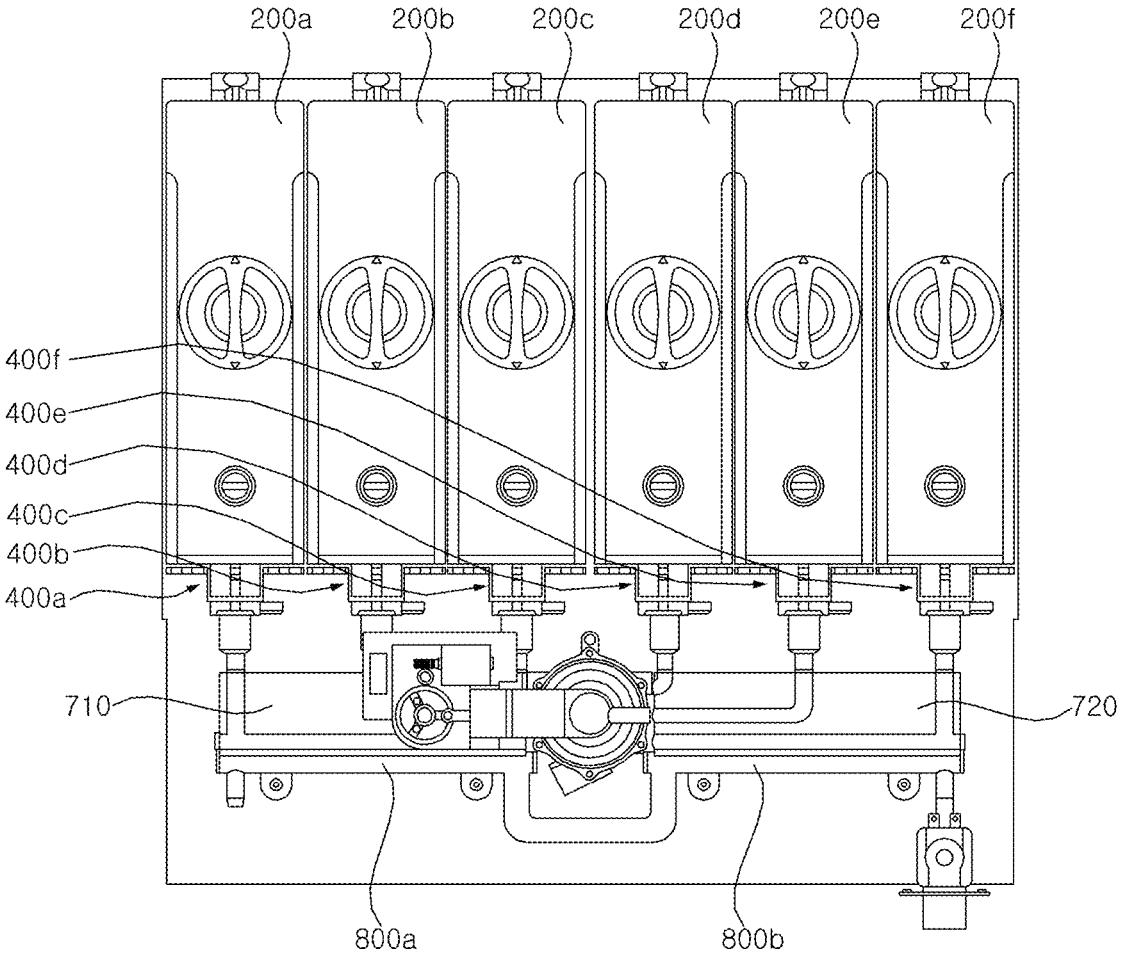
FIG. 7 is a schematic view of the detergent supply device viewed from above.
Figure 8:
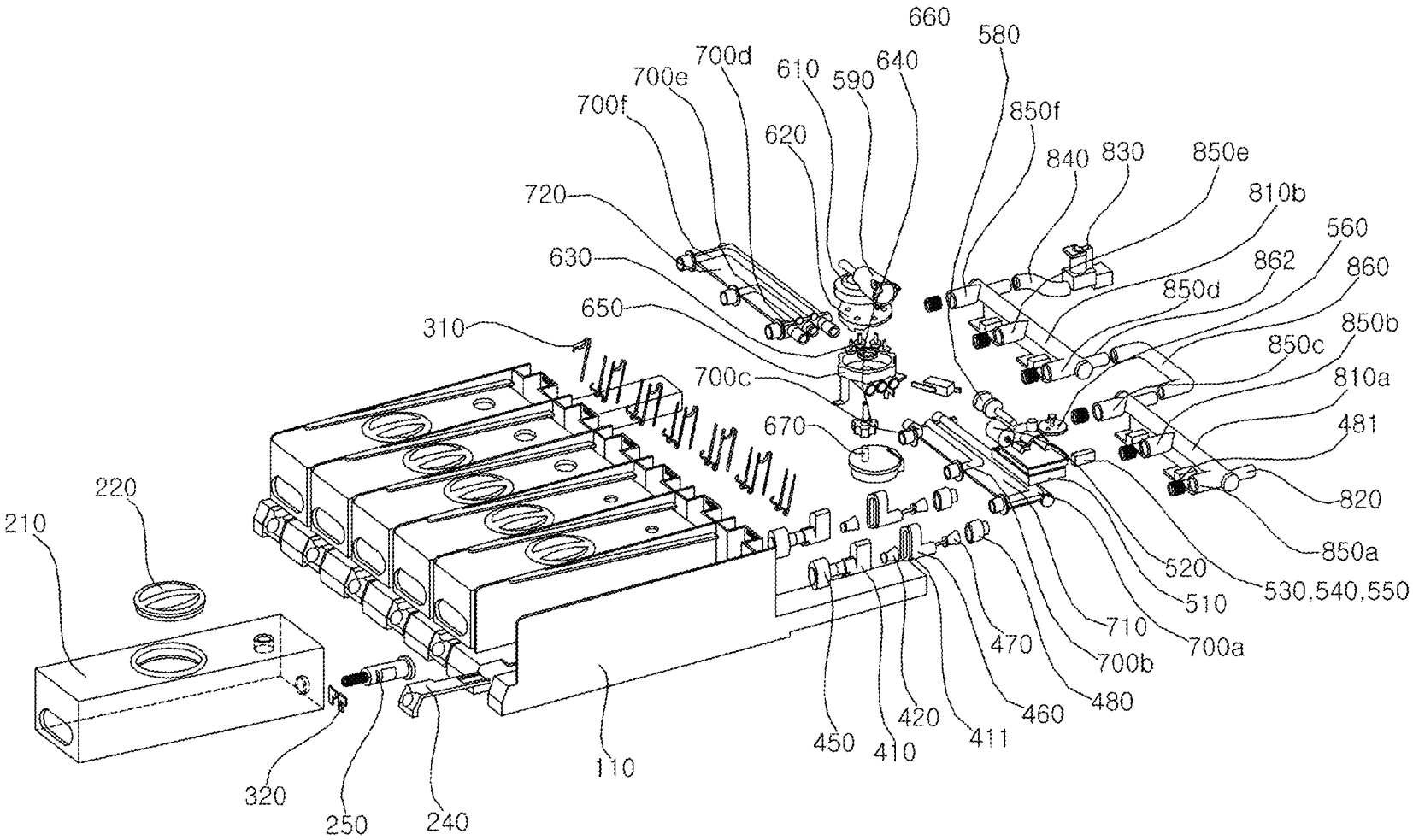
FIG. 8 is an exploded perspective view of the detergent supply device according to an exemplary embodiment of the present disclosure.
Figure 9:
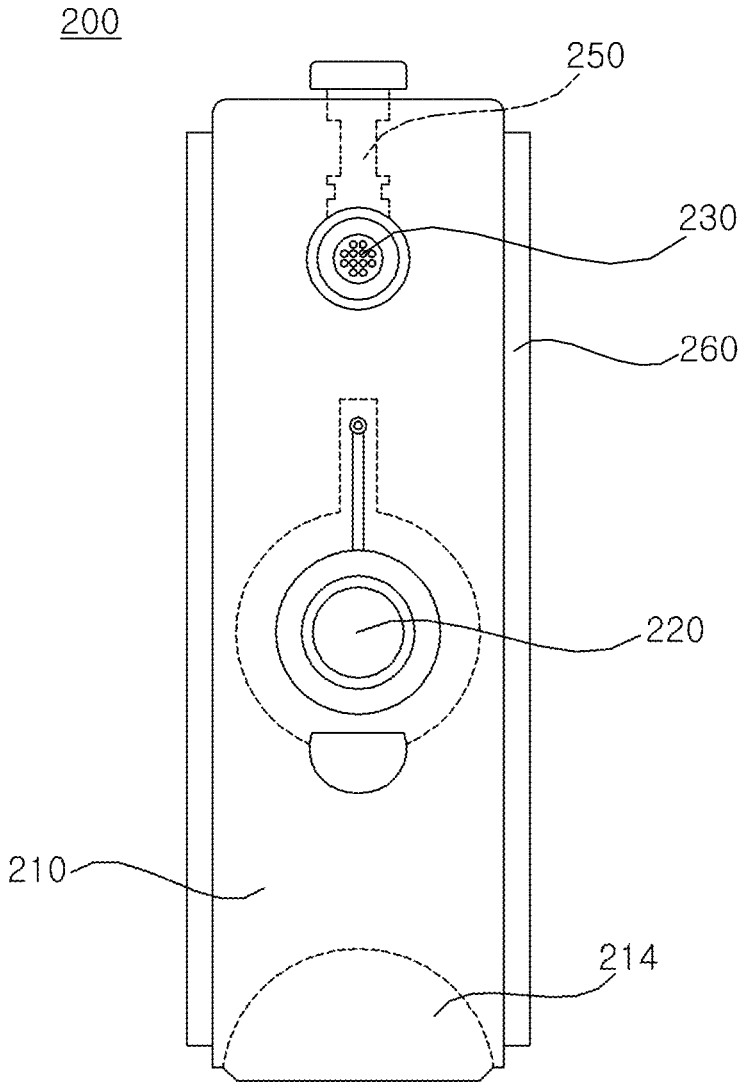
FIG. 9 is a schematic view of a cartridge of the detergent supply device according to an exemplary embodiment of the present disclosure.

Referring to FIG. 1 through FIG. 3, a washing machine according to an exemplary embodiment of the present disclosure includes a cabinet 10 and a detergent supply device 100 disposed at an upper surface of the cabinet 10.

The cabinet 10 is formed as an appearance of a washing machine, and a tub 31 and a drum 32 are disposed in the cabinet 10. The cabinet 10 includes a main frame 11 having a front surface opened, a left surface 11*a*, a right surface 11*b* and rear surface 11*c*, a front panel 12 having a loading/unloading opening and connected to the front surface of the main frame 11, and a planar base 13 supporting the main frame 11 and the front panel 12 from the below. A door 14 opening and closing the loading/unloading opening is mounted rotatably to the front panel 12.

The front panel 12 and the tub 31 are communicated to each other with a circular gasket 33. A frontal end portion of the gasket 33 is mounted at the front panel 12, a rear end portion of the gasket 33 is mounted fixedly along a circumference of an inlet of the tub 31. The gasket 33 is formed as a material having elasticity and capable of preventing water in the tub 31 from leaking.

A driving portion 15 is disposed at a rear side of the drum 32 so as to rotate the drum. Further, there may be provided with a water supply hose (not shown) guiding water supplied from an external water source and a water supply portion 37 controlling water supplied from the water supply hose to a water supply passage 36. The water supply portion 37 may include a water supply valve (not shown) opening/closing the water supply passage 36.

The cabinet 10 includes a drawer 38 accommodating detergent and a drawer housing 40 accommodating the drawer 38 so that the drawer 38 is withdrawable therefrom. The detergent may also include bleach or fabric softener as well as detergent for laundry. Detergent accommodated in the drawer 38 is provided to the tub 31 through a water supply bellows 35 when water is supplied through the water supply passage 36. A water supply hole (not shown) connected to the water supply bellows 35 may be disposed at a side of the tub 31.

The tub 31 may include a drain discharging water, and a drain bellows 17 may be connected to the drain. A drain pump 19 pumping water discharged from the tub 31 through the drain bellows 17 so as to discharge the water to the outside of the washing machine.

Referring to FIG. 1 through FIG. 8, a water supply device 100 mounted at an upper surface of the cabinet according to an exemplary embodiment of the present disclosure will be described in the following.

The water supply device 100 includes a housing 110 having a door disposed at a front side thereof and defining an accommodating room inside thereof, and a cover 120 opening and closing the housing 110.

An opening formed as a rectangular cuboid made of various surfaces is disposed at a front side of the housing 110, and each of the opening is extended from a rear side of the housing 110 so as to form a room for a cartridge corresponding to each of the opening. That is, each of a plurality of cartridges 200, 200*b*, 200*c*, 20*d*, 200*e*, 200*f* (hereinafter referred to as "200") may be inserted to each opening room.

Detergent is accommodated in each of the cartridges 200, and preferably each detergent may have differential composition ratio. Although the number of cartridges according to an exemplary embodiment of the present disclosure may be six, the number of the cartridges are not limited to any particular number, and it is preferable to employ three cartridges or more.

An accommodating space for accommodating passages 700, 800, a passage switching valve 600 and a pump 500 is disposed at a rear side of the cartridge. Cartridge connecting walls 111 are installed between the accommodating space and an accommodating space disposed at a rear side thereof so as to accommodate parts, and then a terminal and an electrode sensor 300 having an electrode plate are installed at the cartridge connecting walls.

The pump 500 and the passage switching valve 600 may be controlled by a controller 3. Information about contents of detergent and various composition ratio of contents may be stored in a memory 4. One of the contents is accommodated in each of the cartridges 200, and the controller 3 controls the pump 500 and the passage switching valve 600 according to information stored in the memory 4.

The washing machine may further include an input unit 5 for obtaining various control command related with an operation of the washing machine from a user. The input unit 5 may be disposed at an upper side of the front panel 12. A display 6 indicating the operating status of the washing machine may be disposed at the front panel 12.

The controller 3 may select a type of detergent from the memory 4 according to a setting value that a user had input with the input unit 5, and the controller 3 may identify information about the detergent. And then, the controller 3 may control the pump 500 and the passage switching valve 600 so as to eject the selected detergent. Thus, the controller 3 may control the pump 500 corresponding to the cartridge 200 accommodating the selected detergent according to the composition ratio and the passage switching valve 600.

Hereinafter, referring to FIG. 5 through FIG. 8 and FIG. 9, cartridges 200 installed at the detergent supply device according to an exemplary embodiment of the present disclosure will be described.

The cartridges 200 may include a cartridge body 210 accommodating detergent, a detergent inlet 211 for injecting detergent into the cartridge body, cap 220 for opening and closing the detergent inlet 211, a membrane 230 allowing air in the cartridges to flow to the outdoor, a cartridge locker 240 allowing the cartridge 200 to fixedly connect to the housing 110 in a case that the cartridge is inserted to the housing 110, a docking valve 250 connecting a check valve 400 and the cartridge 200 and a rib 260.

The cartridge body 210 may be formed such as being corresponded to the appearance of the housing 110 so that the cartridge body 210 is snugly inserted to the accommodating room disposed at a front side of the housing 110. According to an exemplary embodiment of the present disclosure, the cartridge accommodator 110 takes the form of rectangular, and also the cartridge 200 takes the form of rectangular corresponding to the appearance of the cartridge accommodator, and further the cartridge accommodators may have rounded corner so as to reduce abrasion occurred during assembling and disassembling of the cartridge 200.

The detergent inlet 211 may be disposed at a front side of the cartridge body 210, and a cap 220 opening and closing the detergent inlet 211 is disposed at the detergent inlet 211. When it is required to put detergent into the washing machine, detergent is put into the cartridge body 210 through the cap 220 opened. And then, the cap 220 must be closed after finishing putting detergent therein so as to prevent detergent from being discharged to outdoor.

The membrane 230 guiding the air in the cartridge to flow to the outdoor may be mounted at a front side and an upper side of the cartridge body 210. The membrane 230 may keep a pressure of the cartridge and an external pressure the same so as to prevent detergent of the cartridge from supplying to the check valve inadvertently. Further, it is impossible for liquid-phase detergent to discharge to the outdoor through the membrane 230, so it is possible to prevent detergent from being harden by evaporation.

The cartridge locker 240 is disposed at a front surface of the cartridge accommodator 110 and a lower side of the cartridge. The cartridge locker 240 may secure the cartridge 200 for preventing the cartridge from being disassembled when the cartridge is snugly inserted thereto.

The docking valve 250 is disposed between a check valve assembly 400 and the cartridge 200 so as to connect the check valve assembly 400 with the cartridge, and so detergent of the cartridge may be supplied to an inlet passage 700 or an outlet passage 800 through the check valve assembly 400.

The rib 260 is mounted at the both sides of the cartridge body 210 so as to function as a guide allowing the cartridge 200 to be inserted into the cartridge accommodator 110 easily, and further the rib 260 may allow the cartridge body 210 to be arranged slantly so that detergent is not contacted to the membrane 230 in a case that the cartridge is leaned.

Figure 10:
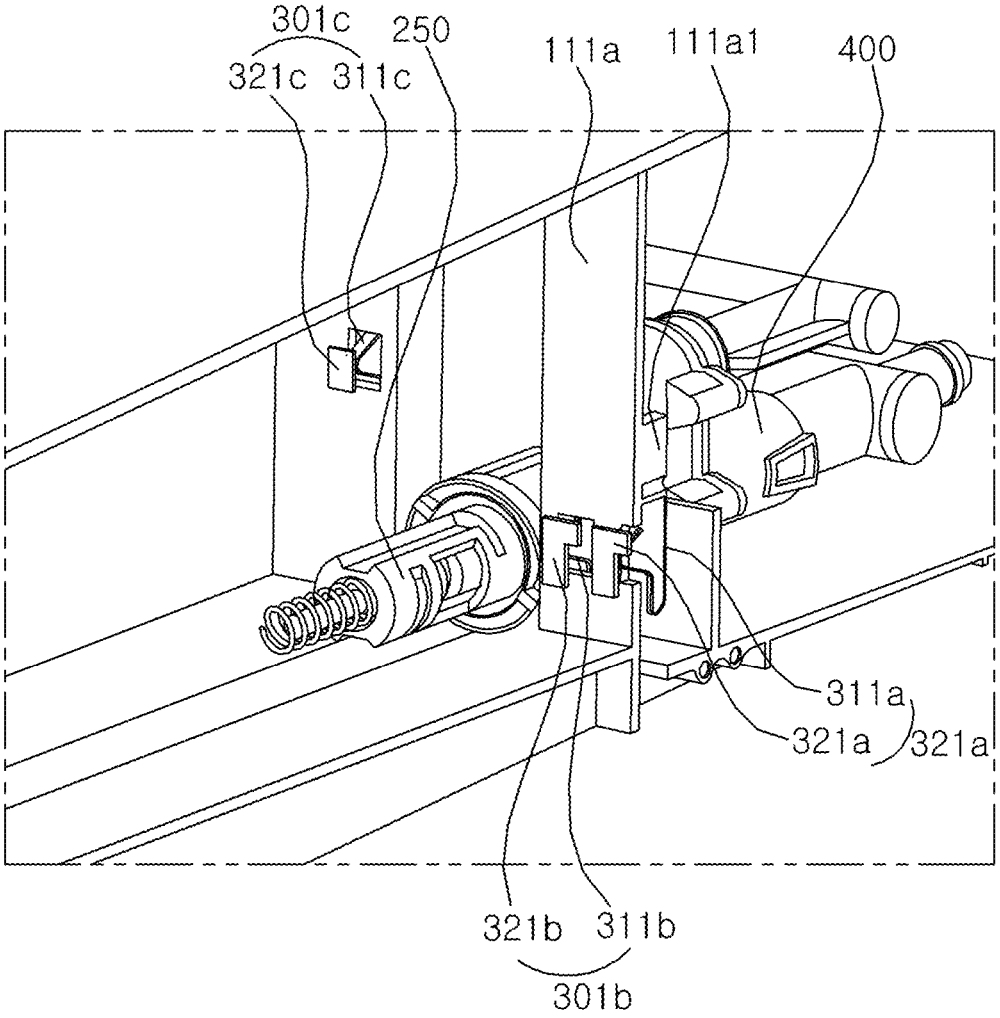
FIG. 10 is a schematic view showing an electrode sensor of the detergent supply device according to an exemplary embodiment of the present disclosure.
Figure 11:
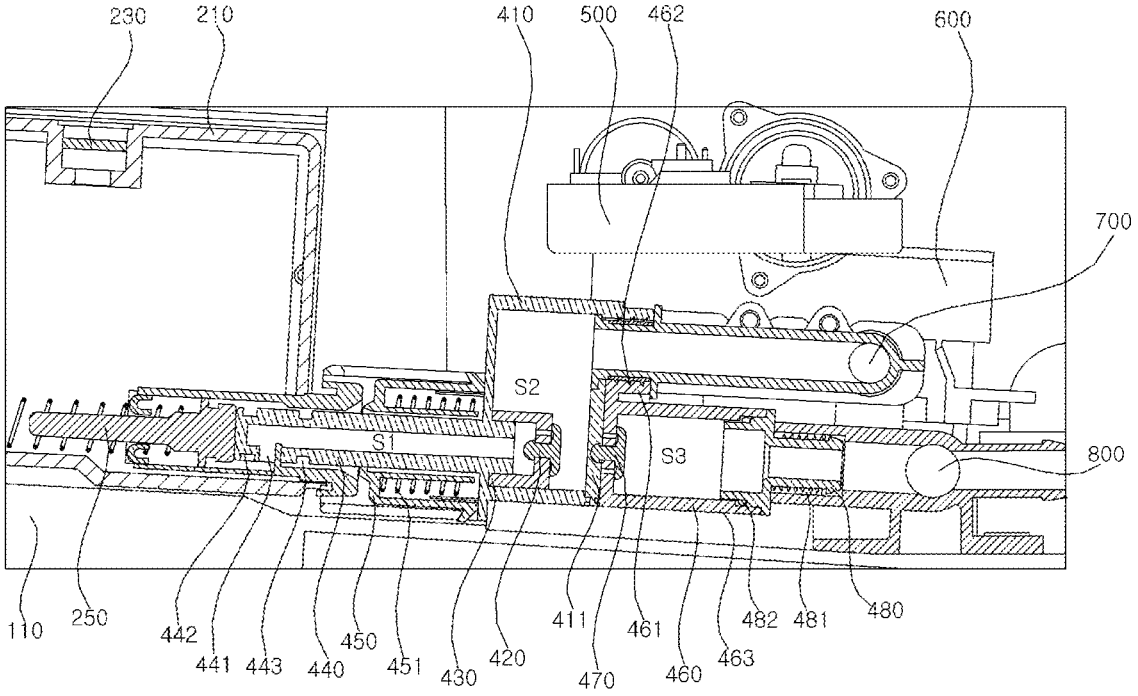
FIG. 11 is a schematic view showing the electrode sensor of the detergent supply device according to an exemplary embodiment of the present disclosure.
Figure 12:
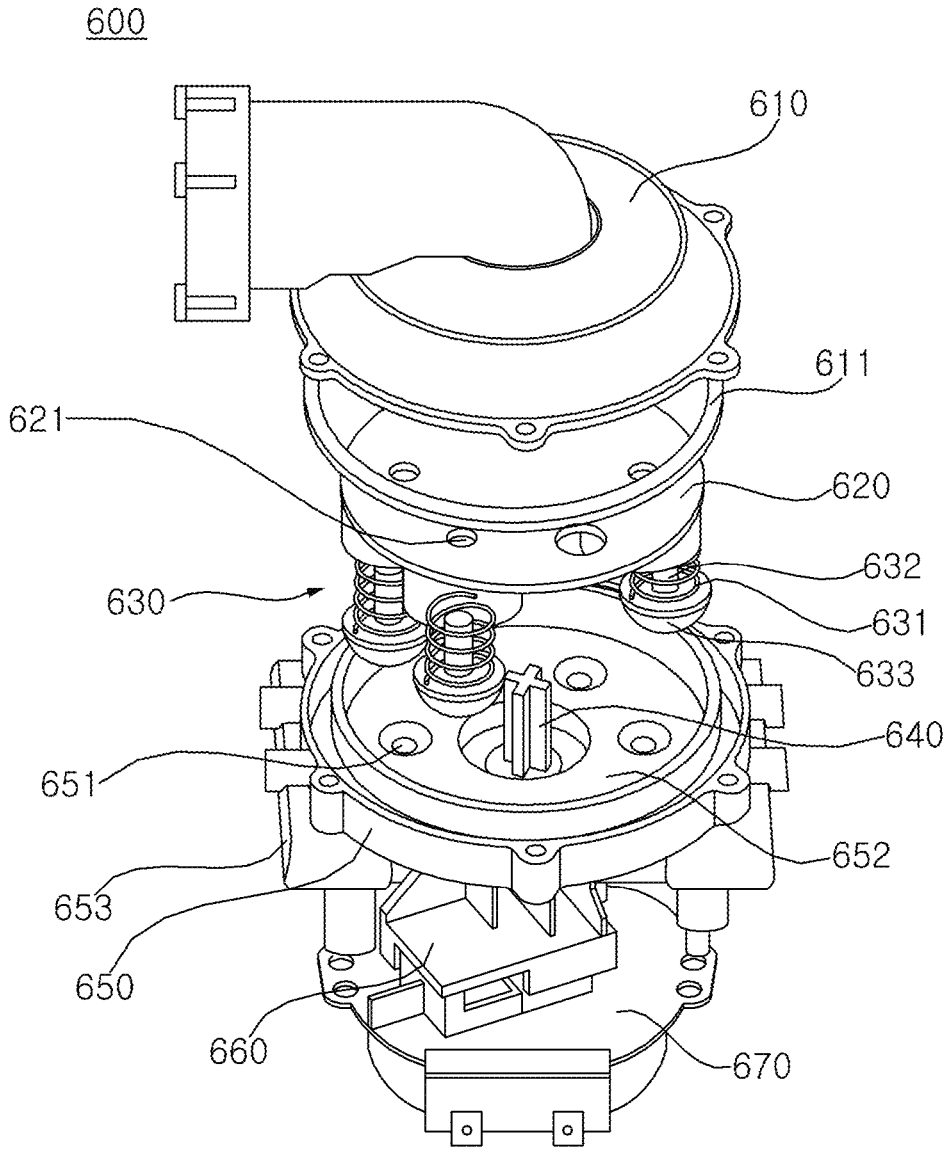
FIG. 12 is a schematic view showing a passage switching valve according to an exemplary embodiment of the present disclosure.
Figure 13:
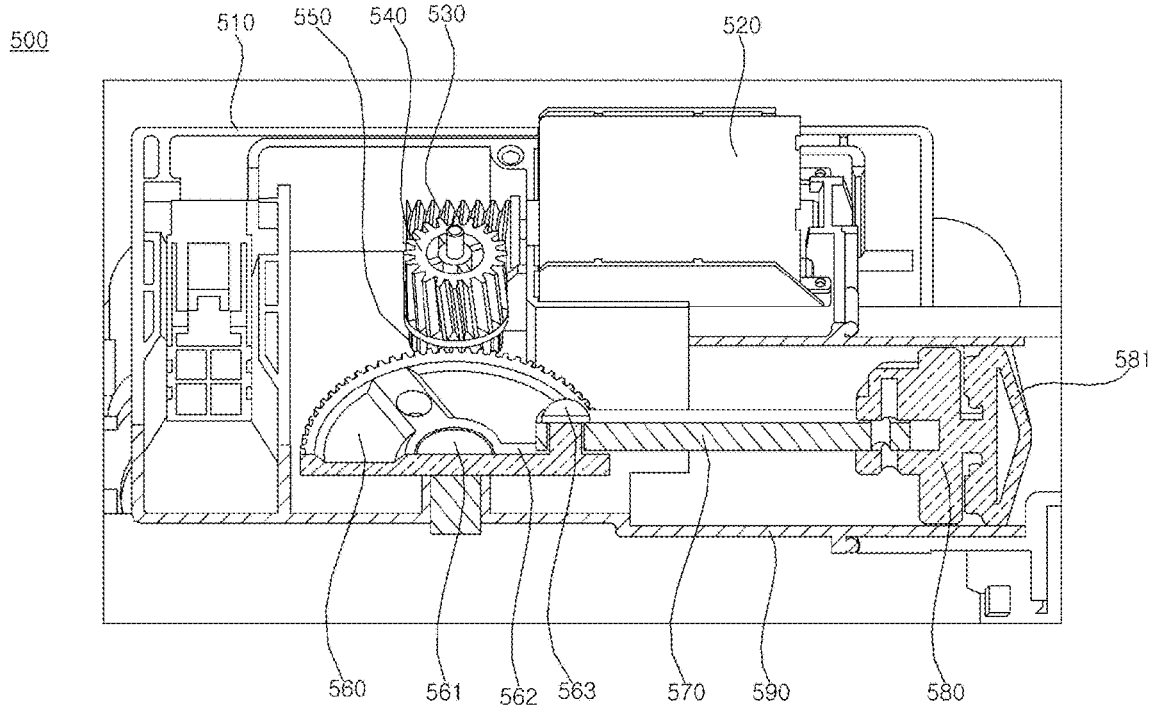
FIG. 13 is a schematic view showing a pump of the detergent supply device according to an exemplary embodiment of the present disclosure.
Figure 14:
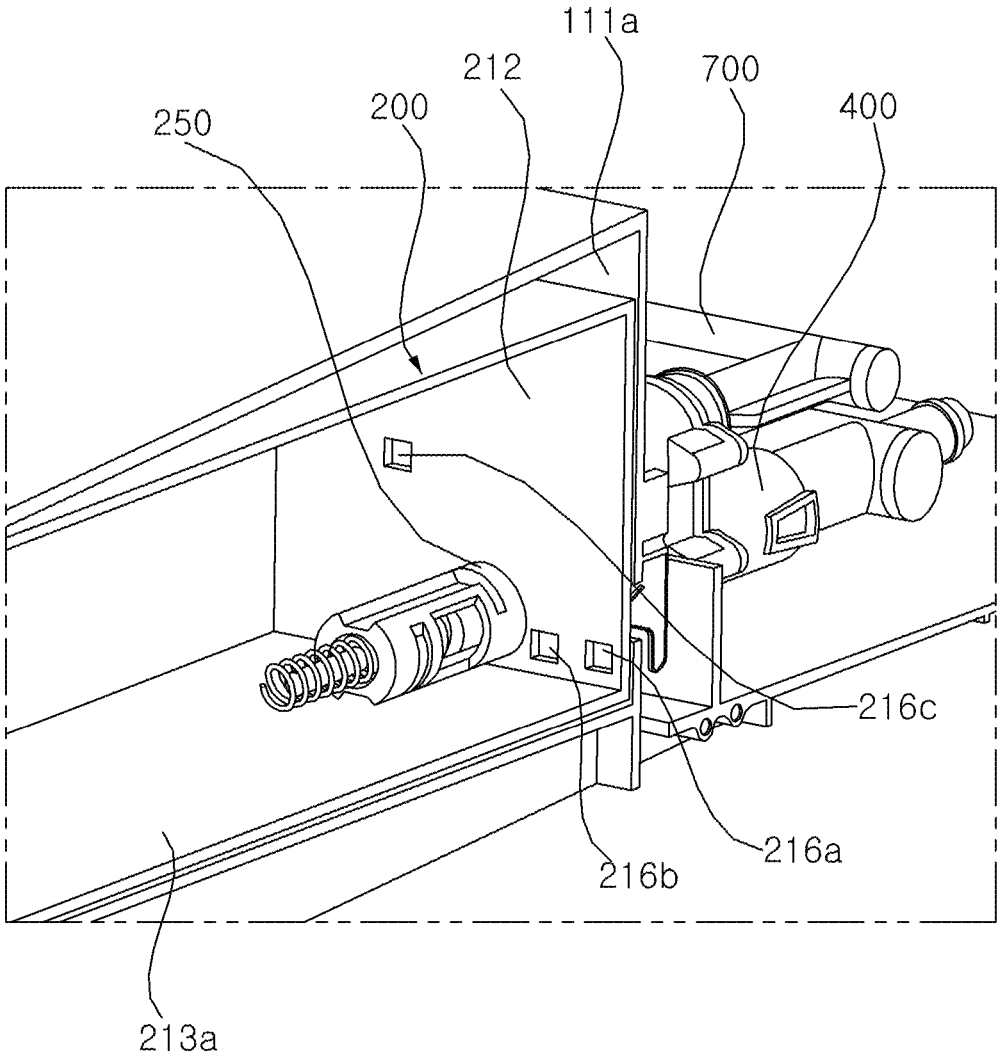
FIG. 14 is a schematic view showing a state that the cartridge is inserted in the structure shown in FIG. 10.
Figure 15:
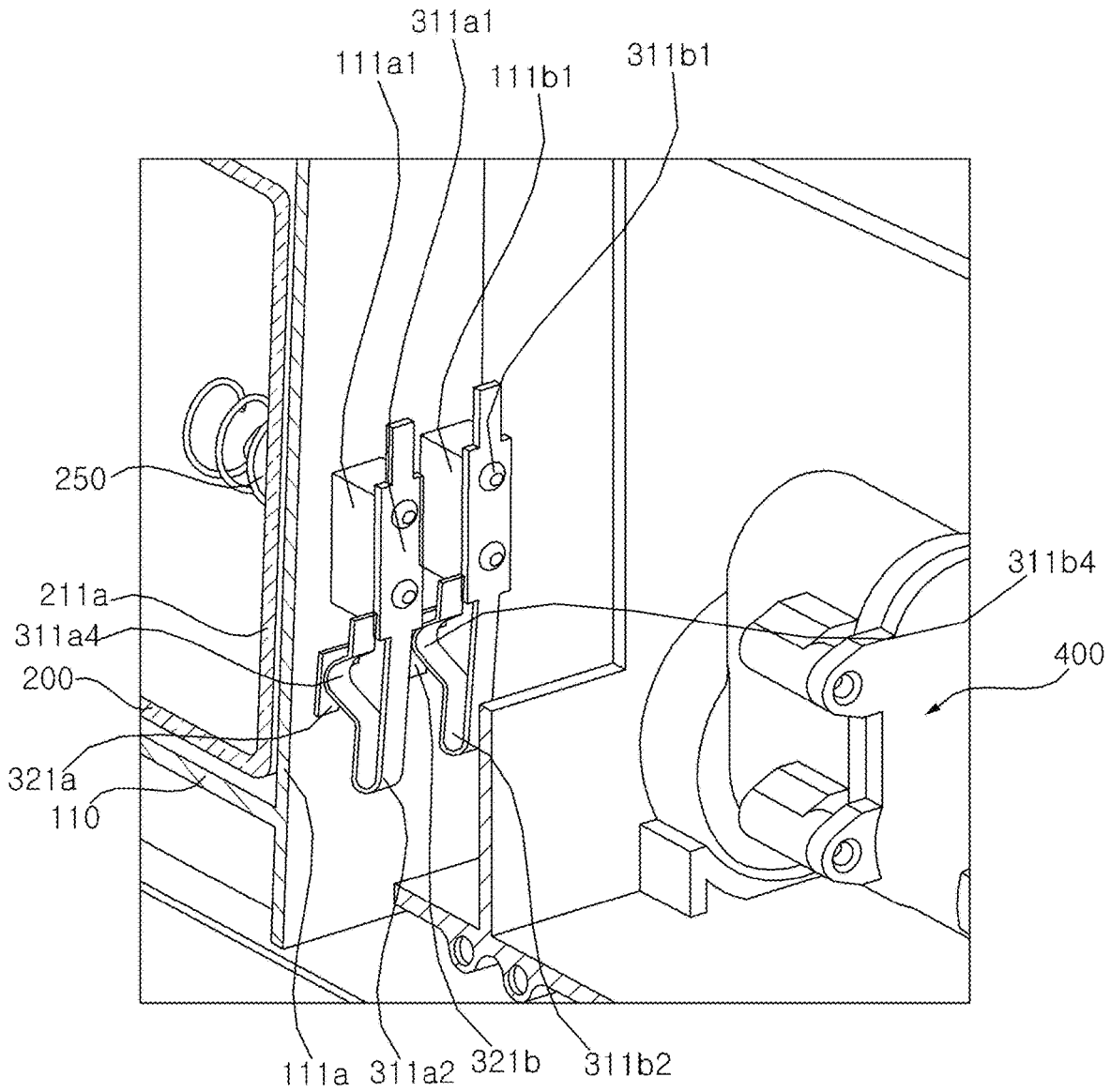
FIG. 15 is a schematic view showing positions of a first electrode plate, a second electrode plate and a third electrode plate of a rear side of the cartridge according to an exemplary embodiment of the present disclosure.
Figure 16:
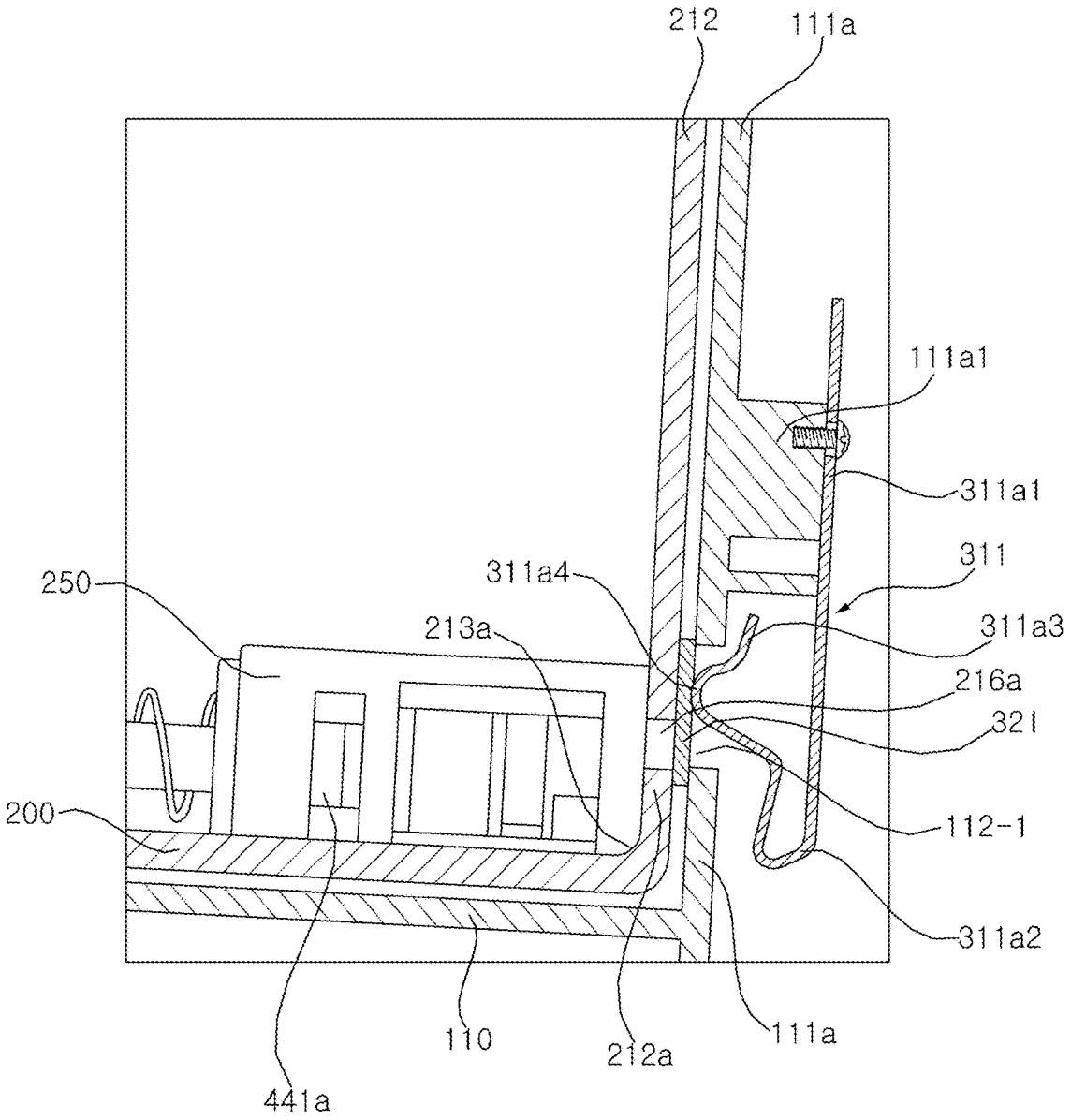
FIG. 16 is a schematic view showing a terminal disposed at a rear side of the cartridge according to an exemplary embodiment of the present disclosure.
Figure 17:
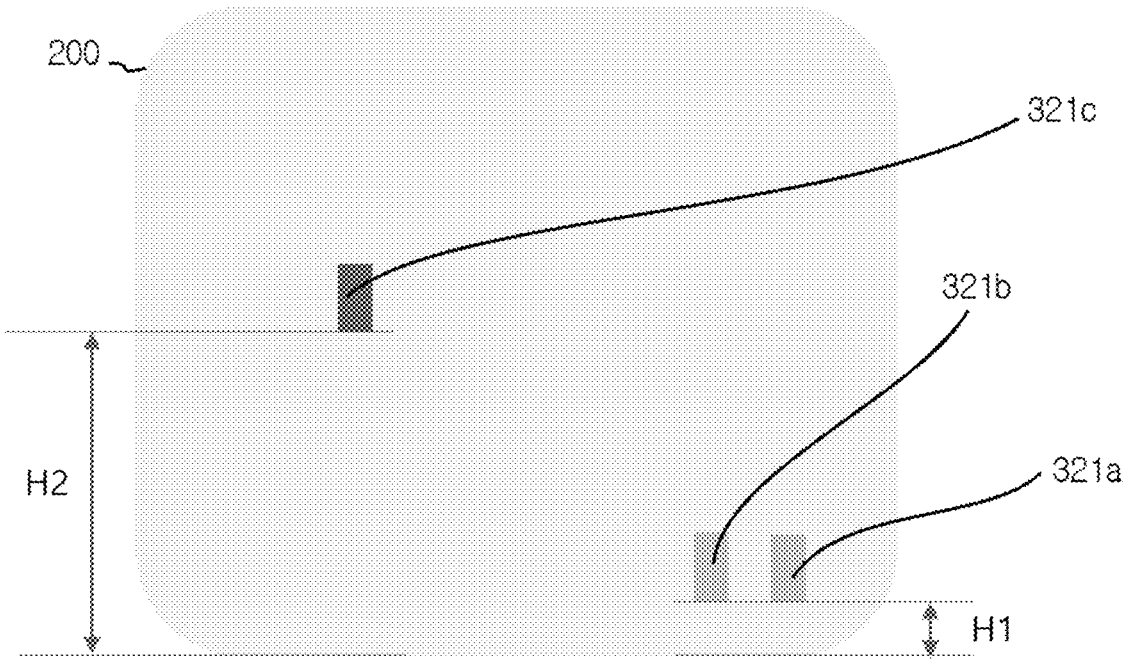
FIG. 17 is a schematic view showing the electrode sensor according to an exemplary embodiment of the present disclosure.
Figure 18:
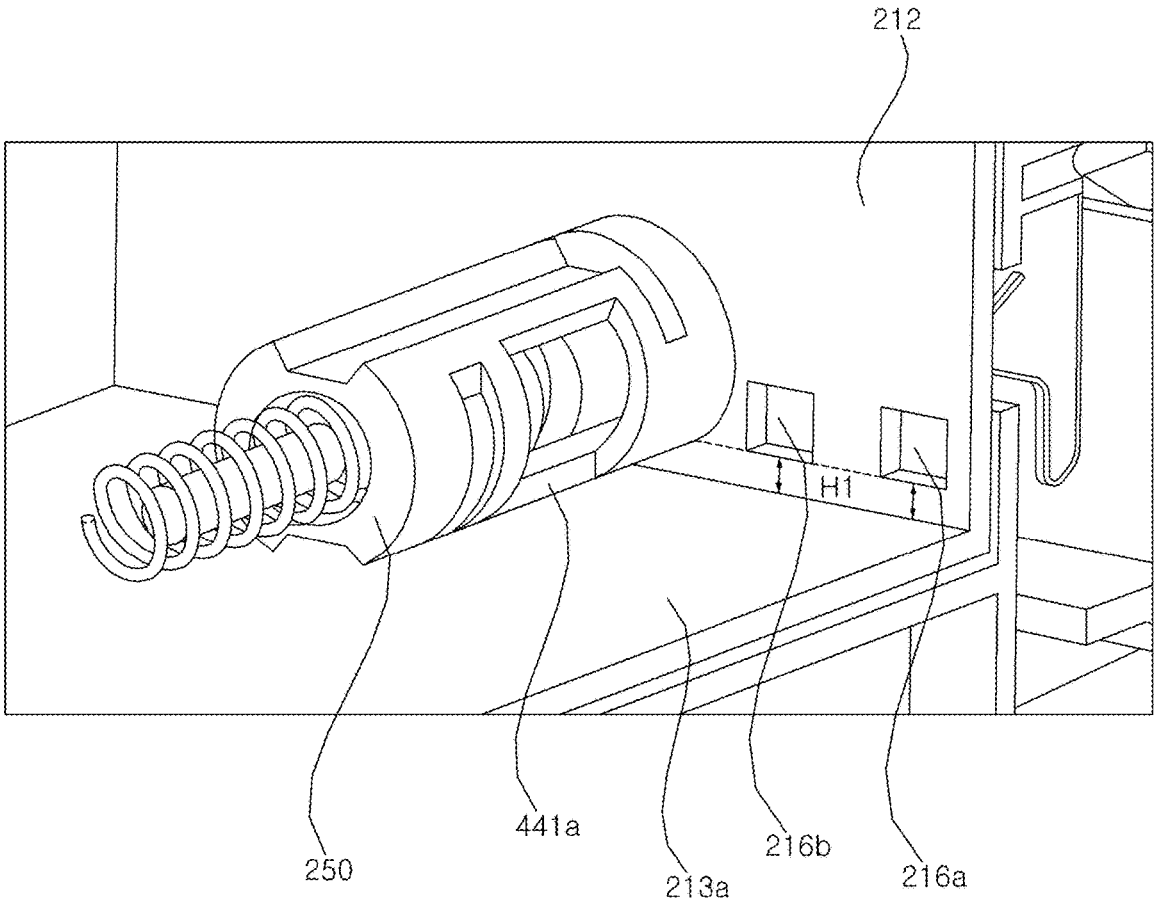
FIG. 18 is a schematic view showing a state that the terminal is spaced apart from a lower surface of the cartridge according to an exemplary embodiment of the present disclosure.
Figure 19:
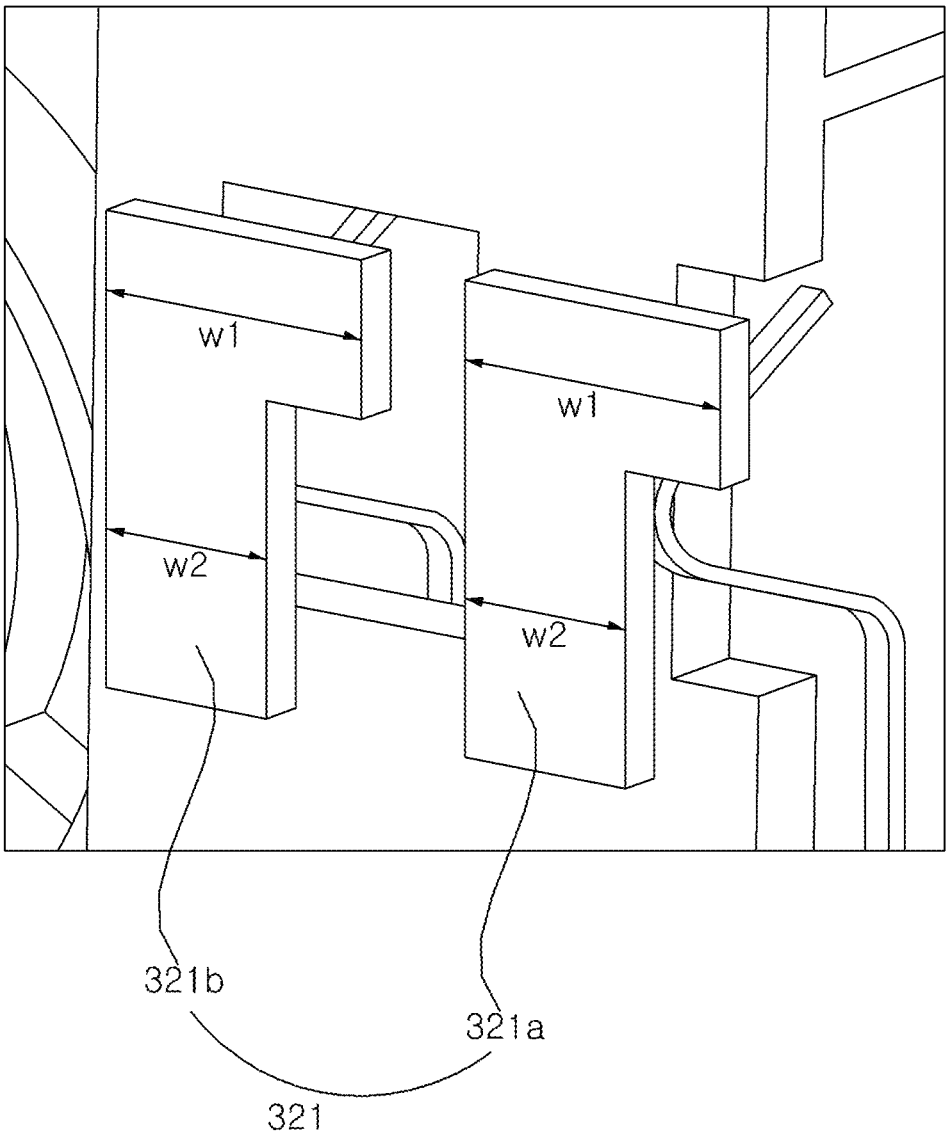
FIG. 19 is a schematic view showing a difference between an upper width of the electrode plate and a lower width of the electrode plate according to an exemplary embodiment of the present disclosure.

Hereinafter, referring to FIG. 4 through FIG. 8 and FIG. 10, and FIG. 4, especially FIG. 10 and FIG. 14, structure and operation of an electrode sensor 300 disposed at a rear side of the cartridge will be described.

An electrode sensor according to an exemplary embodiment of the present disclosure may include a terminal and an electrode plate. According to an exemplary embodiment of the present disclosure, electric sensors 300*a*, 300*b*, 300*c*, 300*d*, 300*e*, 300*f* are respectively disposed correspondingly to six cartridges 200, 200*b*, 200*c*, 200*d*, 200*e*, 200*f*, and each of the electric sensors may include a first electrode sensor, a second electrode sensor and a third electrode sensor so as to be corresponded to each of the cartridges.

The first electrode sensor may include a first terminal and a first electrode plate and the second electrode sensor may include a second terminal and a second electrode plate and the third electrode sensor may include a third terminal and a third electrode plate in the same manner.

Hereinafter, an electric sensor installed at one cartridge 200 of the six cartridges in which a plurality of the electrode sensors include electrode plate 321.

Specifically, the electrode sensor includes the first electrode sensor 301*a*, the second electrode sensor 301*b* and the third electrode sensor 301*c*.

The first electrode sensor 301*a* includes the first terminal 311*a* and the first electrode plate 321*a*.

The second electrode sensor 301*b* includes the second terminal 311*b* and the second electrode plate 321*b*.

The third electrode sensor 301*c* includes the third terminal 311*c* and the third electrode plate 321*c*.

Hereinafter, referring to FIG. 5 through FIG. 8 and FIG. 11, structure and operation of a check valve assembly 400 will be described.

A check valve 400 according to an exemplary embodiment of the present disclosure may include first check valve housings 410, a first check valve 420 installed at the first check valve housing 410, a check valve cap 430 for preventing detergent and air from leaking through the first check valve 420, a docking pipe 440*a*, 440 capable of moving detergent of the cartridge 200 toward the check valve in a state of being connected to the docking valve 250 of the cartridge 200, a docking pipe circumference 450, a second check valve housing 460, a second check valve 470 installed at the second check valve housings 460, and an outlet passage connecting pipe 480 connected to the outlet passage 800 in state of being connected to the second check valve housing 460.

A check valve o-ring 411 may be snugly inserted between the first check valve housing 410 and the second check valve housing 460 so as to connect the first check valve housing 410 to the second check valve housing 460 and function to provide airtight.

The first check valve 420 and the second check valve 470 according to an exemplary embodiment of the present disclosure may be formed as rubber. As the result of the foregoing, there is no need to employ spring as conventional manner because it is possible to block one-way flow of fluid by using elastic force of rubber, so it is possible to minimize a space of the housing, and further arrange various parts therein without any space loss.

The first check valve 420 and the second check valve 470 are disposed along the opposite direction to that of the cartridge 200. Thus, the first check valve 420 is capable of being opened only in a direction toward a second space S2, and the second check valve 470 is capable of being opened only in a direction toward a third space S3.

A detergent inlet 441 allowing detergent supplied from the cartridge 200 to inject to the docking valve are disposed at the docking pipe 440. A first docking pipe o-ring 442 and a second docking pipe o-ring 442 are snugly inserted to a first docking pipe o-ring grooves 442 and a second docking pipe o-ring groove 443 so as to prevent detergent from leaking to the outside while detergent is injected to the detergent inlet.

A docking pipe springs 451 are installed at the docking pipe circumference 450. The docking pipe spring 451 is capable of connecting fixedly the check valve assembly 400 to the docking valve 250 through an elastic force of the docking pipe spring, and further easily disassembling the cartridge 200 from the housing 110 through the elastic force of the docking pipe spring.

An inlet passage connector 461 connected to the inlet passage 700 and an outlet passage connector 463 connected to the outlet passage 800 are installed at the second check valve housing 460. The inlet passage connector 461 is snugly connected to the inlet passage 700 through the an inlet passage connector cover 462.

The outlet passage connecting pipe 480 is fixedly connected to an end of the outlet passage connector 463 by an outlet passage connecting o-ring 482. The outlet passage connecting pipe 480 is snugly connected to the outlet passage 800 by an outlet passage connecting cover 481.

A negative pressure and a positive pressure generated by a reciprocating movement of the piston 580 disposed at the pump 500 is delivered to the second space S2.

According to an exemplary embodiment of the present disclosure, a negative pressure generated by a reverse movement of the piston 580 is delivered to the second space S2 through the inlet passage 700. Thus, the first check valve 420 is opened by the negative pressure of the second space S2. Further, detergent had placed in the cartridge 200 is delivered by the negative pressure to the second space S2 through the first space S1 of the docking pipe 440*a* via the first check valve 420.

When detergent is delivered into the second space S2, a positive pressure generated by a forward movement of the piston 580 is delivered to the second space S2 through the inlet passage 700. Thus, the second check valve 470 is opened by a positive pressure of the second space S2, and the first check valve 420 is kept closed. And then, detergent had placed in the second space S2 is delivered to the third space S3 of the second check valve housing 460 by a positive pressure of the second space S2. Detergent supplied in the third space S3 is discharged to the outlet passage 800 by a positive pressure of the second space S2 and the third space S3 and is delivered to the tub 31 or the drawer 39 etc. with supplied water.

Hereinafter, a structure and an operation of a pump 500 according to an exemplary embodiment of the present disclosure will be described.

A pump 500 according to an exemplary embodiment of the present disclosure includes a housing 510 accommodating pump parts, a motor 520 generating power, a first gear 530 rotated by the motor 520, a second gear 540 rotating in a state of being engaged with the first gear 530, a third gear 550 rotating in a state of being engaged with the second gear 540, a crank gear rotating in a state of being engaged with the third gear 550, a connecting rod 570 connecting the crank gear 560 to the piston, a piston 580 delivering positive pressure or negative pressure to the passage switching valve 600 using by reciprocating movement, and a cylinder 590 defining a room for a space of the piston's reciprocating space.

The first gear 530 is engaged with the motor so as to be integrally rotated with the motor 520. The first gear 530 may be a helical gear. A helical gear has an advantage of reducing a noise generated in the motor 520 and transferring power easily. The second gear may be a worm gear. Since the pump 500 is installed between the inlet passage 700, the outlet passage 800 and the passage switching valve 600 etc., there is a need to assemble with high density for space efficiency. Therefore, according to an exemplary embodiment of the present disclosure, the motor 520 may be installed horizontally, and the second gear 540 may function as a worm gear so as to switch a direction of rotating power and deliver thereto.

The second gear 540 and the third gear 550 are integrally rotated. The crank gear 560 is rotated in a state of being engaged with the third gear 550. The crank gear 560 may have the greater number of teeth than that of the third gear 550 so as to deliver strong power thereto during reciprocating movement of the piston 580.

The crank gear 560 includes a crank shaft 561 functioning as a rotating axis of the crank gear, a crank arm 562 extended from the crank shaft, and a crank pin 563 connected to the connecting rod 570. The crank pin 563 and the connecting rod 570 are rotatably connected to each other so that the connecting rod 570 is capable of linearly moving along a direction of the cylinder 590 according to rotation of the crank pin 563 during rotation of the crank gear 560.

The connecting rod 570 is connected to the piston 580, and the piston 580 is snugly inserted to the cylinder 590 so as to move reciprocatively along a longitudinal direction of the cylinder 590. At this time, positive pressure or negative pressure may be delivered to the passage switching valve 600 connected to the cylinder 590 through a linear movement of the piston 580. When the piston 580 is moved toward the passage switching valve 600, positive pressure is delivered to the passage switching valve 600, and on the other hand, when the piston 580 is moved along the opposite direction of the passage switching valve 600, negative pressure is delivered to the passage switching valve 600.

Hereinafter, referring to FIG. 5 through FIG. 8 and FIG. 12 through FIG. 13, a structure of a passage switching valve 600 will be described.

A passage switching valve 600 according to an exemplary embodiment of the present disclosure includes an upper housing 610 connected to the cylinder 590 of the pump 500, a lower housing 650 connected to the upper housing 610, a disc 620 rotatably disposed in the housing 610, a spring valve 630 disposed at the disc 620, a shaft 640 rotating the disc 620, a micro switch 660 disposed at a lower side of the lower housing 650 and a passage switching motor 670 rotating the shaft 640.

A passage connecting opening 651 respectively connected to inlet passages 700*a*, 700*b*, 700*c*, 700*d*, 700*e*, 700*f* are disposed at the lower housing 650 so that fluid that has passed through a disc hole 621 of the disc 620 may pass through the passage connecting opening 651. And then the fluid is supplied to each inlet passage 700 connected thereto via the passage outlet opening 653.

The spring valve 630 is installed at the disc hole 621 of the disc 620. The spring valve 630 includes a spring 631 providing an elastic force, a spring shaft 632 preventing the spring 631 from being separated, and a cover unit 633 covering the passage connecting opening 651 with an elastic force of the spring 631.

Hereinafter, referring to FIG. 5 through FIG. 8 and FIG. 12 through FIG. 13, an operation of a passage switching valve 600 will be described in detail.

When detergent is selected for being supplied, the passage switching motor 670 is operated by electric power supplied. The operated passage switching motor 670 functions to rotate the shaft 640 connected thereto and also the disc 620 connected to the shaft 640.

At this time, the spring valve 630 installed at the disc 620 is also integrally rotated corresponding to a rotation of the disc 620, and when the passage connecting opening 651 of the lower housing 650 is positioned at a rotary position of the spring valve 630, the cover unit 633 functions to block the passage connecting opening 651 by using an elastic force of the spring 631.

The controller 3 may control a rotary angle of the disc 620 so as to prevent the spring valve 630 from positioning at the passage connecting opening 651 connected to the check valve assembly 400, and so as to connect the check valve assembly 400 connected with cartridge accommodating detergent for supply to the pump 500.

When the spring valve 630 is not placed at the passage connecting opening 651, the pump 500 and the passage connecting opening 651 are opened and positive or negative pressure generated in the pump 500 is sequentially delivered to the inlet passage 700 and the check valve assembly 400 through the passage connecting opening 651 so as to supply detergent of the cartridge 200 to the outlet passage 800.

While the controller 3 controls a rotary angle of the disc 620, the spring valve 630 is placed at the passage connecting opening 651*a* connected to the check valve assembly 400 and the cover unit 633 functions to block the passage connecting opening 651*a* with an elastic force of the spring 631 so as to cut off the flow between the check valve assembly 400 connected to cartridge having no need to be supplied and the pump 500.

When the spring valve 630 is placed at the passage connecting opening 651, the flow of the pump 500 through the passage connecting opening 651 is cut off, and positive pressure or negative pressure generated in the pump 500 is not moved to the check valve assembly 400, so detergent in the cartridge 200 is not moved.

It is required to detect a rotary angle of the disc 620 with the micro switch 660 to put the disc 620 on a desired rotary angle so as to precisely control the rotary angle of the disc 620.

While the spring valve 630 of the disc 620 is not placed on a position of the passage connecting opening 651, the spring valve 630 is placed on an upper surface 652 of the lower housing 650. And when the spring valve 630 is placed on a position of the passage connecting opening 651 by rotation of the disc 620, the spring valve 630 is extended so as to block the passage connecting opening 651.

A plurality of passage connecting openings 651 is capable of being opened so that a plurality of detergent is supplied. And, a plurality of spring valves 630 may be provided so as to block the plurality of passage connecting openings 651.

Hereinafter, referring to FIG. 5 through FIG. 8, an inlet passage 700 and an outlet passage 800 will be described in detail.

According to an exemplary embodiment of the present disclosure, the inlet passage 700 is connected to the inlet passage connector 461 of the check valve assembly 400, and further the inlet passage 700 is connected to the passage outlet openings 653 of the passage switching valve 600 so as to deliver fluid delivered by the pump 500 to the check valve assembly 400.

A plurality of inlet passages 700*a*, 700*b*, 700*c*, 700*d*, 700*e*, 700*f* are respectively connected to each of the plurality of inlet passage connectors 461 and each of the plurality of passage outlet openings 653.

According to an exemplary embodiment of the present disclosure, there may be the passage switching valve 600 disposed at a center thereof, three cartridges 200 disposed at both sides thereof and a check valve assembly 400 connected to the three cartridge 200.

The inlet passages 700*a*, 700*b*, 700*c* disposed at the left side thereof is respectively connected to the inlet passage connector 461 of the left check valve assemblies 400, 400*b*, 400*c* and the passage outlet opening 653 disposed adjacently at a left side of the passage switching valve 600.

The inlet passages 700*d*, 700*e*, 700*f* disposed at the right side thereof is respectively connected to the inlet passage connectors 461*d*, 461*e*, 461*f* of the right check valve assemblies 400*d*, 400*e*, 400*f* and the passage outlet openings 653*d*, 653*e*, 653*f* disposed adjacently at a left side of the passage switching valve 600.

The inlet passages 700*a*, 700*b*, 700*c* disposed at a left side thereof through a first inlet passage plate 710 and the inlet passages 700*d*, 700*e*, 700*f* disposed at a right side thereof through a second inlet passage plate 720 are integrally disposed so as to fix the inlet passages, and fluid is stably supplied.

According to an exemplary embodiment of the present disclosure, an outlet passage 800 is connected to an outlet passage connecting pipe 480*a* of the check valve assembly 400, and the outlet passage 800 functions to supply detergent supplied from the outlet passage connecting pipe 481*a* to the tub 31 or the drawer 39 through a provider 820.

A water supply valve 830 is disposed at an end of the outlet passage 800 so as to supply water supplied from the outdoor water source to the outlet passage 800, and then water supplied from the water supply valve 830 is delivered to the outlet passage 800 via a water supply hose 840.

After water is supplied through check valve connectors 850*a*, 850*b*, 850*c*, 850*d*, 850*e*, 850*f* connected to the outlet passage connecting pipe 481 of the check valve assembly 400, the water is discharged to the provider 820 with detergent supplied to the outlet passage 800 while the water is moved toward the provider 820 disposed at the other end of the outlet passage 800.

The check valve connector 850 is connected to a lateral surface of the outlet passage 800. Each of the check valve connector 850 is connected to each of the outlet passage connector 480, so detergent discharged from the outlet passage connector 480 is delivered to the outlet passage 800 through the check valve connector 850.

According to an exemplary embodiment of the present disclosure, the outlet passage 800 is installed such as being divided into a left outlet passage 800*a* and a right outlet passage 800*b* with respect to the passage switching valve 600, and a connecting hose 810 is installed between the left outlet passage 800*a* and the right outlet passage 800*b* so as to connect the left outlet passage 800*a* with the right outlet passage 800*b*. Herein, the connecting hose 810 takes the form of channel-shape so as to make a space for installing the passage switching valve 600, and further to prevent the outlet passage 800 from intervening the passage switching valve 600.

Figure 20:
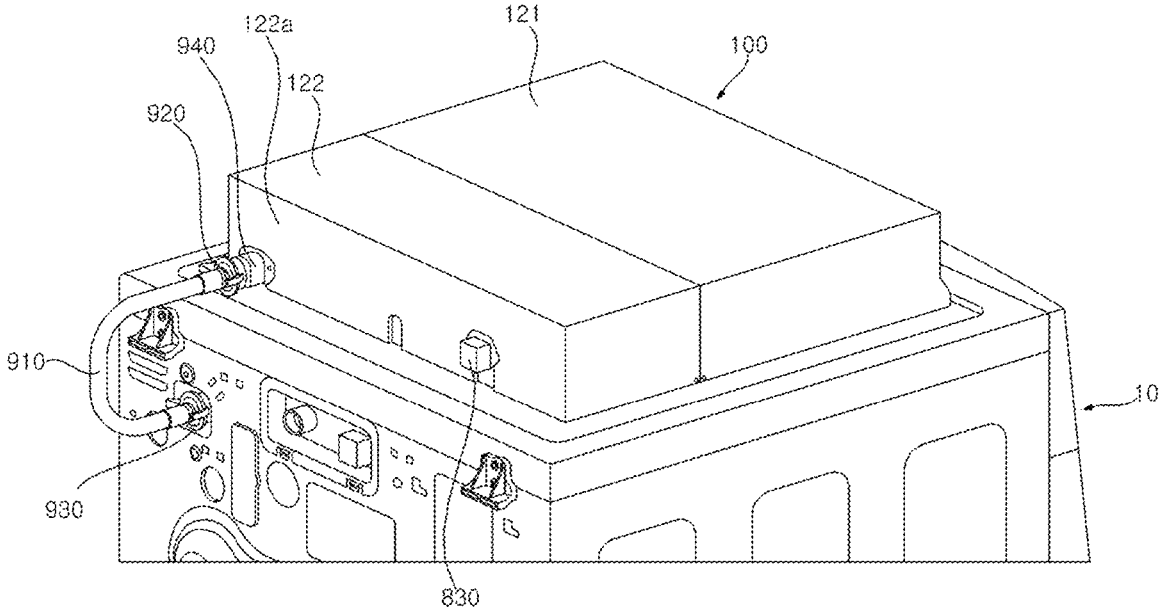
FIG. 20 is a schematic view showing a passage connector.
Figure 21:
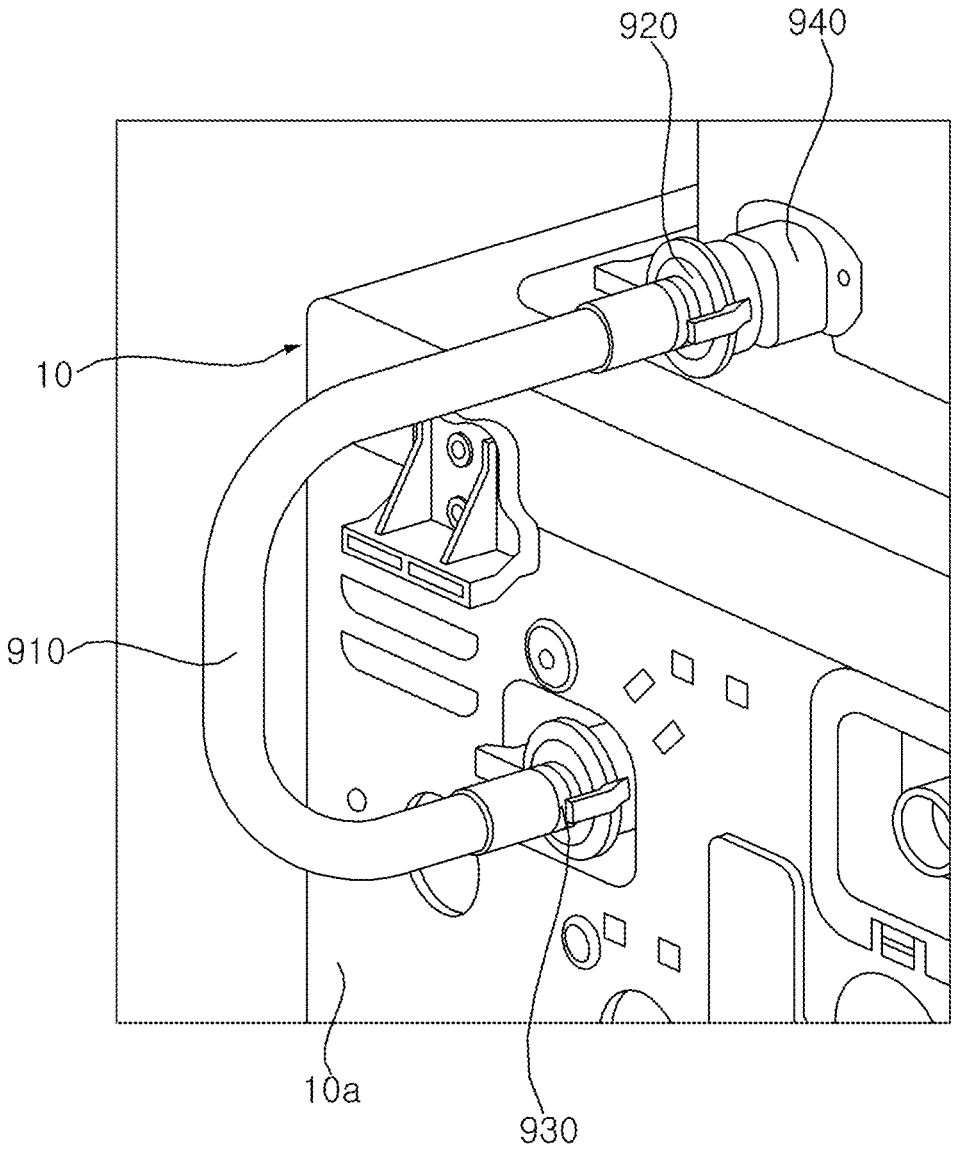
FIG. 21 is an enlarged view showing the passage connector shown in FIG. 20.

Hereinafter, referring to FIG. 20 and FIG. 21, a passage connector 900 according to an exemplary embodiment of the present disclosure will be described.

A passage connector 900 includes a connecting hose 910 connecting the cabinet 10 with the detergent supply device 100, a first head 920 installed at an end of the connecting hose 910 in which the first head 920 is connected to the detergent supply device 100, a second head 930 installed at the other end of the connecting hose 910 in which the second head 930 is connected to the cabinet 10, a first connector 940 connecting the first head with the detergent supply device 100, a second connector 950 connecting the second head 930 with the cabinet 10, a connecting body 960 disposed so as to encompass the connecting hose 910, and a body opening 970 disposed at a center of the connecting body 960.

The passage connector 900 functions to deliver detergent supplied from the outlet passage 800 of the detergent supply device 100 to drawer 39 in the cabinet 10 or tub 31.

A cover 120 of the detergent supply device 100 includes a first cover 121 covering a front side of the cartridge 200 and a second cover 122 covering a rear side of main parts except for the cartridge. The first cover 121 and the second cover 122 may encompass all the surface of the detergent supply device 100.

The first connector 940 is installed at a rear surface of the second cover 122. The first connector 940 includes a head connector 941 connected to the first head 920, a head mount 942 mounted to the first head 920, a supporter 943 fixing the first connector 940 to a rear surface of the second cover and a supply connector 944 connecting the first connector 940 with the outlet passage 800.

The head connector 941 is inserted inside a space in which the first head 920 defines, so that detergent and water discharged from the head connector 941 are delivered to the connecting hose 910 through the first head 920.

A ball 921 is installed at an inner circumference of the first head 920, and the first head 920 is mounted at the head connector 942 of the first connector 940 when the first head 920 is inserted to the first connector 940. Thus, the ball 922 and the head connector 942 are fixedly connected to each other so that the first head 920 and the first connector 940 are not separated from each other while fluid is discharged to the connecting hose 910.

The supporter 943 takes the form of plate in which the supporter 943 is disposed perpendicular to a longitudinal direction of the first head 920 at a center of the first head 920. The plate-shaped supporter 943 is contactly mounted at a rear surface of the second cover 122. The supporter 943 functions to secure the first connector 940 so as to prevent the first connector 940 from being swayed by oil pressure. According to an exemplary embodiment of the present disclosure, a hole is be formed at the supporter 943 so that the supporter 943 can be bolted to a rear surface of the cover, but is not limited thereto.

The supply connector 944 is connected to the supplying pipe of the outlet passage 800 so that water blended with detergent in which the water discharged from the outlet passage 800 is delivered to the connecting hose 910.

The second connector 950 is installed at a rear surface 10*a* of the cabinet 10. The second connector 950 includes a head connector 951 insertly connected to the second head 930, a head connector 952 connected to the second head 930, a supporter 953 securing the second connector 950 to a rear surface 10*a* of the cabinet and an inlet connector 944 connecting the second connector 950 with the tub 31 or the drawer 39.

The head connector 951 is inserted to inside a space where the second head 930 is penetrating, and then the head connector 951 delivers detergent and water supplied from the connecting hose 910 and the second head 930 to the tub 31 of the cabinet or the drawer 39.

A ball 931 is installed at an inner circumference of the second head 930 in which the ball is mounted to the head connector 952 of the first connector 950, when the second head 930 is inserted to the second connector 950. Thus, the ball 931 and the head connector 952 are fixedly connected to each other so as to prevent the second head and the second connector from being separated from each other by oil pressure while fluid is discharged to the tub 31 of cabinet or the drawer 39.

The supporter 953 takes the form of plate in which the supporter 953 is disposed perpendicular to a longitudinal direction of the first head 930 at a center of the second head 930. The plate-shaped supporter 953 is contactly mounted to a rear surface 10*a* of the cabinet so as to prevent the second connector 950 from being swayed by oil pressure. According to an exemplary embodiment of the present disclosure, a hook is disposed at the supporter 953 so as to be connected to a rear side of the cabinet, but is not limited thereto.

The inlet connector 954 may be connected to the tub 31 or drawer 39. In a case that the inlet connector 954 is connected to the tub 31 detergent had passed through the inlet passage 954 may be directly delivered to the tub 31. Meanwhile, in a case that the inlet connector 954 is connected to the drawer 39 detergent had passed through the inlet connector 954 may be delivered to the tub 31 through the drawer 39.

The first head 920 and the second head 930 are disposed respectively detachably to the first connector 940 and the second connector 950. Thus, when the detergent supply device 100 is not in use, the first head 920 and the second head 930 are separated from the first connector 940 and the second connector 950, and then the passage connector 900 is separated from the cabinet 10 and the detergent supply device 100. In other hands, when the detergent supply device 100 is in use, the first head 920 and the second head 930 are connected to the first connector 940 and the second connector 950, and then the passage connector 900 is connected to the cabinet 10 and the detergent supply device 100, so detergent of the detergent supply device 100 is capable of being delivered to the tub 31 in the cabinet 10.

The first connector 940 is installed at a rear surface of the second cover 122 and the second connector 950 is installed at a rear surface of the cabinet 10, and further the passage connector 900 is installed at a rear side of the cabinet 10. That is, the passage connector 900 is installed at an invisible position to a user, so it is possible to provide natural appearance between the passage connector 900 and the other parts.

Referring to the attached drawings according to the other exemplary embodiment of the present disclosure, there may be further included a connecting body 960 disposed so as to encompass the connecting hose 910. The connecting body 960 is made of hard material, while the connecting hose 910 is made of soft material. Therefore, a user can easily assemble or disassemble the passage connector 900 with grabbing a body opening 970 of the connecting body 960 when a user has the intend of assembling or disassembling the passage connector 900.

To supply detergent accommodated in the cabinet to a main washing machine through the detergent supply device, it is required to determine if the main washing machine is connected with the detergent supply device, and in doing so, after information about a laundry that was identified in the main washing machine is transmitted to the detergent supply device, appropriate detergent is supplied to the laundry.

Hereinafter, referring to FIG. 10 and FIG. 14 through FIG. 19, structure of an electrode sensor and a terminal according to an exemplary embodiment of the present disclosure will be described.

The electrode sensors 301*a*, 301*b*, 301*c* are installed at a connecting wall 111*a* formed at the housing 110 into which cartridge 200 is inserted. The electrode plates 321*a*, 321*b*, 321*c* are installed between the cartridge connecting wall 111*a* and the cartridge rear wall 212, and the terminals 311*a*, 311*b*, 311*c* are installed at protrusions 111*a*1, 111*b*1 protruding toward an opposite direction from the cartridge at the cartridge connecting wall 111*a*. For instance, the terminal 311*a* includes connecting portion 311*a*1 mounted to the protrusion 111*a*1 of the connecting wall 111*a* of the housing 110, a first curved portion 311*a*2 bending for from the connecting portion, and a second curved portion 311*a*3 bending upward and then forward from the first curved portion 311*a*2, wherein the second curved portion has a protruding portion 311*a*4 toward the electrode plate 321.

The connecting portion 311*a*1 is formed as being plate-shaped and is mounted to the protrusion 111*a*1. According to an exemplary embodiment of the present disclosure, the connecting portion 311*a*1 is bolted, but is not limited thereto. Rather, the connecting portion 311*a*1 may be mounted thereto in any other manners. The first curved portion 311*a*2 is spaced apart from the protruding portion 311*a*4 of the second curved portion 311*a*3, and the first curved portion 311*a*2 provides an elastic force so that the protruding portion 311*a*4 of the second curved portion 311*a*3 keeps in contact with the electrode plate 321. Repulsive force against a deformation of the first curved portion 311*a*2 elastically acts on the second curved portion 311*a*3 so that the second curved portion 311*a*3 keeps in contact with the electrode plate 321.

As can be seen from the foregoing, the protruding portion 311*a*4 of the second curved portion 311*a*3 pushes the electrode plate 321 toward the cartridge and simultaneously is contacted to the electrode plate 321. Specifically, a connecting wall opening 112-1 is formed at the cartridge connecting wall 111*a*, and the protruding portion 311*a*4 contacts to the electrode plate 321 rough the connecting wall opening 112-1. In doing so, the terminal 311 can receive an electric signal from the electrode plate 321. The electric signal received in the terminal 311 may transmit to the controller 3 through an electric wire.

Openings 216*a*, 216*b*, 216*c* are formed and functions as a passage connecting an inside of the cartridge with the electrode plate. Therefore, when detergent is filling at any height in the cartridge, detergent can be contacted to the electrode plate 321 through the opening, so the electrode plate is electrified by the contacted detergent.

The electrode plate 321 is snugly contacted to the cartridge rear wall 212*a* so that detergent in the cartridge is not leaked through a clearance between the electrode plate 321 and the cartridge rear wall 212*a*. As a result of the forgoing, the electrode plate 321 is disposed between the connecting wall 111*a* and the cartridge rear wall 212*a*, and is secured by the protruding portion 311*a*4 to the cartridge rear wall 212*a* which is placed at a front side of the electrode plate 321 and the connecting wall 111*a* is placed at a rear side of the electrode plate 321.

The terminal 216*a*1 is disposed at a lower end of the electrode plate 321. The protruding portion 311*a*4 is contacted to an upper side of the electrode plate 321. Thus, detergent is contacted to the lower end of the electrode plate 321 through the terminal 216*a*1, and an electric current is received through the protruding portion 311*a*4 connected to an upper side of the electrode plate.

A width of a lower end of the electrode plate 321 is smaller than an upper end of the electrode plate 321. Because the upper end of the electrode plate has a greater width, it is possible to easily contact to the protruding portion. Because a lower end of the electrode plate has the smaller width, comparably small amount of detergent may be contacted thereto. Therefore, it is possible to reduce a chance that detergent would contact to the electrode plate or detergent would be hardened on the electrode plate so as to cause a misjudgment of detecting amount of detergent. Further, because the electrode plate has the smaller lower end where detergent would contact, adjoining electrode plates are spaced apart from each other, so it is possible to reduce a chance of an intervening between adjoining electrode plates. According to an exemplary embodiment of the present disclosure, the electrode plate 321 may have a smaller width W2 at a lower end than an upper width W1 in which the lower end of the electrode plate 321 is formed as being L-shaped, but is not limited thereto. Therefore, detergent is hardly contacted to the lower end of the electrode plate, and it is preferable that electrode plate is formed as a shape capable of reducing an interference therebetween.

Openings 216*a*, 216*b* are formed with spaced apart from a lower surface 213*a* of the cartridge. Specifically, the openings 216*a*, 216*b* must be located at a higher position than the detergent inlet 441*a* placed at the docking valve 250 which is mounted to a lower side of the cartridge rear wall 212*a* and is connecting the pump 500 with the cartridge 200. This is because it is required to detect a residual amount of detergent before a cartridge is completely out of detergent, and it is required to let a user know the residual amount of detergent. Therefore, because it is no use to detect a residual amount of detergent before detergent is supplied to the pump 500 through the detergent inlet 441*a*, the opening 216*a* must be placed at a higher than the detergent inlet 441*a*.

At least two of a plurality of the electrode sensors have a different height each other. A conventional a pair of electrode sensors detect a residual amount of detergent in such a state that the pair of electrode sensors are installed adjacently to each other with the same height. Like that, when only two electrode sensors are installed per cartridge, there may be a problem that it is difficult to precisely detect a residual amount of detergent, because cartridge is swayed or detergent is hardened on an electrode sensor even though detergent is not filling at an adequate height.

The second two electrode sensors comprise two electrode sensors of which at least one electrode sensor is placed higher than the first two electrode sensors.

Thus, a first two electrode sensors and a second two electrode sensors are included. The first two electrode sensors comprise the first electrode sensor 301*a* and the second electrode sensor 301*b*, wherein the first and the second electrode sensors may be positioned at same height H1, According to an exemplary embodiment of the present disclosure, there may be provided with three electrode sensors. The first two electrode sensors may detect a first sensor value, and the second two electrode sensors may detect a second sensor value. That is, it is possible to increase an accuracy of detecting residual amount of detergent, and also to determine a malfunction thereof or unmount, etc. by the first sensor value and the second sensor value.

The electrical sensor 300 outputs an electric signal when positive and negative electrode sensors spaced apart from each other are electrified through a medium. That is, detergent contained in the cartridge functions as the medium so as to generate an electric current or an electric voltage at the electrode sensors, and amount of detergent in the cartridge is detected by the terminal.

One of the first two electrode sensors is formed as a receiver and the other is formed as a transmitter, and in the same manner in case of the second two electrode sensors. The second two electrode sensor may include one of the first two electrode sensors and a third electrode sensor disposed higher than the first and second electrode sensors.

One of the first two electrode sensors included in the second electrode sensors is formed as a receiver, and the third electrode sensor is formed as a transmitter, and vice versa.

Hereinafter, referring to FIG. 10 and FIG. 14 through FIG. 19, a structure of an electrode sensor and a terminal according to an exemplary embodiment of the present disclosure will be described.

According to an exemplary embodiment of the present disclosure, the terminal and the electrode plate is included in each electrode sensor. The first terminal 311*a*, the first electrode plate 321*a* the second terminal 311*b*, and the second electrode plate 321*b* are disposed at a lower position and at a side of docking valve.

The third terminal 311*c* and the third electrode plate 321*c* are disposed at higher position and at the other side of the docking valve 250.

The first and second electrode plates 321*a*, 321*b* are installed parallel to a height H1 at a rear surface of a cartridge. The third electrode plate 321*c* is installed at a higher position H2 than a position H1 at a rear surface of a cartridge. First and second openings 216*a*, 216*b* having a first height H1 from a bottom surface of the cartridge and a third opening 216*c* having a second height H2 from the bottom surface of the cartridge are respectively disposed a cartridge rear wall 212*a* corresponding to a position where the first, second and third electrode plates 321*a*, 321*b*, 321*c* are installed. The first, second and third electrode plates 321*a*, 321*b*, 321*c* are respectively snugly installed at a position corresponding to a position where the first, second and third openings 216*a*, 216*b*, 216*c* are disposed. In doing so, the first, second and third electrode plates 321*a*, 321*b*, 321*c* are exposed to an inside of the cartridge so as to contact to detergent in the cartridge, so an electric current and a voltage may be generated in the electrode plates.

The first, second and third openings 216*a*, 216*b*, 216*c* are respectively placed to be open to a lower ends of the first, second and third electrode plates so that each of the lower ends thereof is contacted to detergent, wherein each of the lower ends of the first, second and third electrode plates has smaller width than the upper ends thereof.

The first and second openings 216*a*, 216*b* are spaced apart from a lower surface of the cartridge 213 by a height of H1, so as to detect a residual amount of detergent.

The first and second electrode plates 321*a*, 321*b* are formed as being L-shaped respectively. That is, each width of lower ends of the first and second electrode plates are formed smaller than that of each upper end thereof. Because each upper end of the first and second electrode plates has a large width W1, it is possible to easily contact to the protruding portion 311*a*4 of the terminal 311*a*. Further, because each lower end of the first and second electrode plates has a small width W2, it is possible to reduce a problem caused by being contacted with detergent, and furthermore to reduce a chance to a misjudgment and interference there between.

Specifically, with respect to each width of lower ends of the first and second electrode plates 321*a*, 321*b*, comparably a small amount of detergent may be contacted thereto so as to reduce a chance that detergent is contacted. Therefore, it is possible to reduce a chance that detergent would contact to the electrode plate or detergent would be hardened on the electrode plate so as to cause a misjudgment of detecting amount of detergent. Herein, because the two electrode plates are closely spaced apart from each other with being parallel at the same height, there is a chance that an interference between the two electrode plates is occurred. So, it is required to employ an electrode plate having a lower end of smaller width in which the lower end is electrified so as to prevent an interference there between.

Because a height of the third electrode plate 321*c* is different from that of the first and second electrode plates 321*a*, 321*b*, and the third electrode plate 321*c* is spaced apart far from the first and second electrode plates 321*a*, 321*b*, there is no need to form the third electrode plate 321*c* as being L-shaped.

Although the embodiments of the present disclosure are described above with reference to the accompanying drawings, the present disclosure is not limited to the above embodiments, and may be manufactured in various forms, and in the art to which the present disclosure belongs, those skilled in the art will appreciate that the present disclosure may be embodied in other specific forms without changing the technical spirit or essential features of the present disclosure. Therefore, it should be understood that the embodiments described above are exemplary in all respects and not restrictive.

What is claimed is:

1. A washing machine comprising:

a cabinet;

a tub located inside the cabinet and configured to receive water;

a drum rotatably provided inside the tub and configured to accommodate laundry therein;

a detergent supply device located at the cabinet and configured to supply detergent into the tub; and a controller configured to control the washing machine, wherein the detergent supply device comprises:

a plurality of cartridges configured to contain detergent, a pump configured to extract detergent from the plurality of cartridges, a passage that guides the extracted detergent into the tub, and a plurality of electrode sensors located at one side of the plurality of cartridges, wherein each of the plurality of electrode sensors comprises:

an electrode plate configured to detect an electric signal, and a terminal connected to the electrode plate and configured to transmit the electric signal detected by the electrode plate, and wherein the electrode plate has a first surface configured to come in contact with detergent contained in the cartridge and a second surface connected to the terminal, wherein the first surface is provided below the second surface, wherein the controller is configured to control the pump and calculate a quantity of the detergent contained in the cartridge according to the transmitted electric signal, wherein each of the plurality of cartridges defines an opening at a rear wall of the each of the plurality of cartridges, and wherein the electrode plate is in contact with the rear wall of the each of the plurality of cartridges to expose the first surface to the opening.

2. The washing machine of claim 1, wherein the electrode plate has a first portion comprising the first surface and a second portion comprising the second surface, and wherein a width of the first portion of the electrode plate is less than a width of the second portion of the electrode plate.

3. The washing machine of claim 2, wherein the opening is in contact with the first portion of the electrode plate.

4. The washing machine of claim 1, wherein the opening is spaced apart from a lower surface of the cartridge.

5. The washing machine of claim 4, wherein the detergent supply device further comprises a docking valve located at a lower side of the rear wall of each of the plurality of the cartridges, the docking valve connecting the pump with the plurality of the cartridges, wherein the docking valve includes a detergent inlet through which the extracted detergent passes from the cartridge into the pump, and wherein the opening is located at a position higher than the detergent inlet.

6. The washing machine of claim 1, wherein the washing machine further comprises a housing that accommodates the plurality of cartridges, the housing having a connecting wall located along a rear direction of the cartridge, and wherein the electrode plate is located between the connecting wall of the housing and the rear wall of the plurality of cartridges.

7. The washing machine of claim 1, wherein the detergent supply device further comprises a housing that accommodates the plurality of cartridges, wherein the terminal comprises:

a connecting portion connected to the housing, a first curved portion that is bent from the connection portion, and a second curved portion that is bent upward and then forward from the first curved portion, and wherein the second curved portion includes a protruding portion that is in contact with the electrode plate.

8. The washing machine of claim 7, wherein the housing comprises a connecting wall located along a rear direction of the plurality of cartridges, and wherein the connecting portion of the terminal is connected to the connecting wall.

9. The washing machine of claim 8, wherein the connecting portion is located on the protrusion portion that protrudes away from the plurality of cartridges from the connecting wall.

10. The washing machine of claim 8, wherein the protruding portion is in contact with the second surface of the electrode plate.

11. The washing machine of claim 10, wherein the connecting wall defines a connecting wall opening, and wherein the electrode plate is in contact with the protruding portion through the connecting wall opening.

12. The washing machine of claim 1, wherein the electrode plate is in an L-shape.

13. The washing machine of claim 1, wherein the plurality of electrode sensors comprise at least two electrode sensors that have different heights from each other.

14. The washing machine of claim 1, wherein three electrode sensors that include three electrode plates and three terminals are located at the one side of the plurality of cartridges, and wherein the three electrode plates include first and second electrode plates having a first height and a third electrode plate having a second height higher than the first height.

15. The washing machine of claim 14, wherein each of the first and second electrode plates is in an L-shape.

16. The washing machine of claim 14, wherein first, second, and third openings that correspond to the first, second, and third electrode plates are located at a rear wall of the plurality of cartridges, and wherein the first surface of the first, second, and third electrode plates are in contact with the detergent contained in the plurality of cartridges through the first, second, and third openings correspondingly.

17. The washing machine of claim 16, wherein the first and second openings are spaced apart from a bottom surface of the plurality of cartridges.

18. The washing machine of claim 16, wherein the first, second, and third openings are located respectively at a lower end of the first, second, and third electrode plates.

19. The washing machine of claim 1, wherein the electric signal comprises at least one of an electric current or an electric voltage generated between two electrode plates located at the one side of the plurality of cartridges.

20. A washing machine comprising:

a cabinet;

a tub located inside the cabinet and configured to receive water;

a drum rotatably provided inside the tub and configured to accommodate laundry therein;

a detergent supply device located at the cabinet and configured to supply detergent into the tub; and a controller configured to control the washing machine, wherein the detergent supply device comprises:

a plurality of cartridges configured to contain detergent, a pump configured to extract detergent from the plurality of cartridges, a passage that guides the extracted detergent into the tub, and a plurality of electrode sensors located at one side of the plurality of cartridges, wherein each of the plurality of electrode sensors comprises:

an electrode plate configured to detect an electric signal, and a terminal connected to the electrode plate and configured to transmit the electric signal detected by the electrode plate, wherein the electrode plate has a first surface configured to come in contact with detergent contained in the cartridge and a second surface connected to the terminal, wherein the controller is configured to control the pump and calculate a quantity of the detergent contained in the cartridge according to the transmitted electric signal, wherein the electrode plate has a first portion comprising the first surface and a second portion comprising the second surface, and wherein a width of the first portion of the electrode plate is less than a width of the second portion of the electrode plate.

21. The washing machine of claim 20, wherein the first surface is disposed below the second surface.

* * * * *